United States Patent [19]

Hosaka

[11] Patent Number: 4,721,083

[45] Date of Patent: Jan. 26, 1988

[54] ELECTRONIC CONTROL SYSTEM FOR INTERNAL COMBUSTION ENGINE WITH STALL PREVENTIVE FEATURE AND METHOD FOR PERFORMING STALL PREVENTIVE ENGINE CONTROL

[75] Inventor: Akio Hosaka, Yokohama, Japan

[73] Assignee: Nissan Motor Company, Limited, Kanagawa, Japan

[21] Appl. No.: 666,360

[22] Filed: Oct. 31, 1984

[30] Foreign Application Priority Data

Nov. 4, 1983 [JP] Japan ..... 58-205930
Jan. 20, 1984 [JP] Japan ..... 59-5192[U]

[51] Int. Cl.[4] ..... F02M 3/06

[52] U.S. Cl. ..... 123/339; 123/493; 180/69.3; 180/165

[58] Field of Search ..... 123/325, 326, 339, 493; 180/165, 69.3

[56] References Cited

U.S. PATENT DOCUMENTS

| | | | |
|---|---|---|---|
| Re. 31,582 | 5/1984 | Hosaka et al. | 364/431.04 |
| 3,452,210 | 6/1969 | Gray . | |
| 4,022,164 | 5/1977 | Fuchs | 123/339 X |
| 4,319,327 | 3/1982 | Higashiyama et al. | 364/431.05 |
| 4,344,398 | 8/1982 | Ikeura | 123/339 |
| 4,345,557 | 8/1982 | Ikeura | 123/339 |
| 4,376,428 | 3/1983 | Hata et al. | 123/417 |
| 4,387,681 | 6/1983 | Ikeura et al. | 123/325 |
| 4,402,217 | 9/1983 | Higashiyama et al. | 73/117.3 |
| 4,402,289 | 9/1983 | Ikeura | 123/339 |
| 4,405,031 | 9/1983 | Rotter | 180/165 |
| 4,406,261 | 9/1983 | Ikeura | 123/339 |
| 4,406,262 | 9/1983 | Ikeura | 123/339 |
| 4,411,171 | 10/1983 | Fiala | 180/165 X |
| 4,419,610 | 12/1983 | Pollman | 318/12 |
| 4,520,777 | 6/1985 | Hatori et al. | 123/339 |
| 4,545,449 | 10/1985 | Fujiwara | 123/339 X |

FOREIGN PATENT DOCUMENTS

| | | |
|---|---|---|
| 0058826 | 9/1982 | European Pat. Off. . |
| 0084116 | 7/1983 | European Pat. Off. . |
| 0085909 | 8/1983 | European Pat. Off. . |
| 2949988 | 7/1980 | Fed. Rep. of Germany . |
| 3333392 | 3/1984 | Fed. Rep. of Germany . |
| 2455188 | 11/1980 | France . |
| 2523525 | 9/1983 | France . |
| 49-40886 | 11/1974 | Japan . |
| 2051420 | 1/1981 | United Kingdom . |
| 2115582 | 9/1983 | United Kingdom . |
| 2117936 | 10/1983 | United Kingdom . |
| 2125578 | 3/1984 | United Kingdom . |

OTHER PUBLICATIONS

Patent Abstracts of Japan, vol. 5, No. 183 (M-97), Nov. 1981.

SEA Technical Paper Series, Asano et al., 800825, Digital Engine Controller, Jun., 1980.

SEA Technical Paper Series, Ikeura et al., 800056, Microprocessor Control Brings About Better Fuel Economy with Good Drivability, Feb., 1980.

*Primary Examiner*—Willis R. Wolfe, Jr.

*Attorney, Agent, or Firm*—Schwartz, Jeffery, Schwaab, Mack, Blumenthal & Evans

[57] ABSTRACT

An engine control system includes a stall-preventive feature in which prevailing engine conditions are checked against patterns known to lead to engine stall. A number of crucial engine parameters and continuously monitored, as are one or a number of subsidiary conditions, such as air conditioner operation and transmission position, which may significantly increase the probability of engine stall under certain, known conditions. When these known conditions are detected, engine parameters are sampled at regular intervals for a predetermined period of time to derive a number of parameter variation curves or patterns which can then be compared to similarly-derived empirical patterns which are known to lead directly to engine stall. When the current and predetermined patterns match or closely correlate, the engine control system is signalled to perform a stall-preventive operation. The stall-preventive operation consists of steps serving to increase engine output torque, decrease the load on the engine or both. For example, the fuel supply may be adjusted in accordance with the predetermined variation patterns. Alternatively, if the air conditioner is running, it may be turned off temporarily until the danger of stalling has passed. In addition, auxiliary devices capable of generating torque independently of the engine may be used briefly to supplement the engine output.

48 Claims, 22 Drawing Figures

ELECTRONIC CONTROL SYSTEM FOR INTERNAL COMBUSTION ENGINE WITH STALL PREVENTIVE FEATURE AND METHOD FOR PERFORMING STALL PREVENTIVE ENGINE CONTROL

BACKGROUND OF THE INVENTION

The present invention relates generally to an electronic control system for controlling operation of an internal combustion engine. More specifically, the invention relates to an engine control system which detects specific engine operating conditions under which engine stall may occur and performs a back-up operation to prevent the engine from stalling.

SAE Papers 800056 and 800825, published by Society of Automotive Engineers discloses electronic control systems for internal combustion engines for controlling fuel supply, fuel injection, auxiliary air flow, spark ignition, exhaust gas recirculation and so forth according to predetermined engine control parameters. Control may be performed in closed loops and/or open loops to derive control signals for each of the enging operating elements controlled depending upon the engine operating conditions. In such control systems, the engine operating conditions to be detected have already occurred some time before they are actually detected. Response lags occur in the control system as well as in the element to be controlled. Such lags may be significant when the engine is under critical conditions.

Numerous experiences of engine stalling under certain driving conditions have been reported such as under relatively heavy load conditions while driving the compressor of an air conditioner, the alternator, the radiator fan and so forth. In modern vehicles, the load on the engine tends to be increased by installation of power steering which requires an engine-driven pump, air-conditioning which requires a compressor driven by the engine, a relatively high-capacity alternator for generating electric power at high ratings, and so forth. Furthermore, increases in the electrically operated accessories such as automotive audio systems, high-capacity blowers for the air conditioner, and so forth, affect engine operation by lowering the supply voltage for an ignition system which may cause engine stalling.

An engine stall preventive engine control system has been proposed in Published Japanese Patent (Tokko) No. Showa 49-40886, published on Nov. 6, 1974. In the disclosed system, actual engine speed is compared with a predetermined threshold. When the engine speed drops below the threshold, a stall-preventing operation is performed. In the stall-preventing operation, an auxiliary air flow rate is increased and/or the fuel supply or fuel injection quantity is increased to increase engine output torque.

However, in the control system of the above-mentioned Published Japanese patent, excessive time lags, which may prevent successful execution of the engine stall-preventing operation, exist due to the nature of the engine itself. For instance, after a control signal is issued to increase the auxiliary air flow rate, the auxiliary air control valve is actuated so as to allow an increased rate of air flow, but only after a certain time lag. The increase in the of auxiliary air flow rate is recognized only after another time lag. After another time lag, the fuel is increased. Finally, engine torque increases to a sufficient level to prevent the engine from stalling. However, the accumulated time lag may be sufficient to allow the engine to stall due to response delays.

In addition, in the aforementioned stall preventing operation, engine operation fluctuates significantly due to response delays in increasing the air flow rate and fuel supply amount and due to significant deviation of air/fuel ratio from the stoichiometric value. This further prevents successful stall prevention.

SUMMARY OF THE INVENTION

Therefore, it is a principle object of the present invention to satisfactorily and successfully prevent the engine from stalling under all load conditions.

Another and more specific object of the invention is to provide an electronic control system for an internal combustion engine which can project probable engine operating conditions at which the engine may stall in order to take stall-preventive steps.

A further object of the invention is to provide a method for projecting probable engine operating conditions to enable stall-preventing operation prior to the actual onset of such engine-stall conditions.

According to the present invention, an electronic control system includes various sensors and/or detectors for detecting engine operating parameters and operating conditions of automotive components affecting engine operation, and means for recording specific conditions of the engine operation parameters and the operating conditions of automotive components whenever the engine stalls. The record in the recording means is a specific pattern of variation of the parameters. The record is accumulated to project the onset of engine stalling conditions during subsequent engine operation. The control system continuously and cyclically checks each parameter to monitor for recorded engine stalling conditions so as to be able to start the stall-preventing operation in advance of such engine stalling conditions. In the stall-preventing operation, the mechanical load and/or electrical load is reduced to increase the engine torque in relation to load, or the engine torque is increased by means of an engine driving component which is driven by a power source other than the engine itself.

According to one aspect of the invention, a stall preventive control system for an internal combustion engine comprises a first sensor for monitoring a preselected engine operation parameter and producing a first sensor signal indicative thereof, a second detector for detecting a preselected engine operating condition on the basis of variations in the first sensor signal and producing a second detector signal indicative thereof, third means, responsive to the second detector signal, for detecting incipient engine stall and producing a third signal when incipient engine stall is detected, and fourth means, associated with the third means and responsive to the third signal, for performing an engine stall preventive operation in which the magnitude of engine output torque relative to the load on the engine is increased.

According to another aspect of the invention, a stall preventive control system for an internal combustion engine comprises a first sensor for monitoring a preselected engine operation parameter and producing a first sensor signal indicative thereof, a second detector associated with the first sensor for detecting instantaneous engine operating conditions and producing a second detector signal indicative of the engine operating conditions, a third means, for recording the first sensor signal value as engine stall condition-indicative data in response to the second detector signal indicative of engine conditions known to lead to stalling, fourth means, responsive to the second detector signal, for deriving engine operating condition data and comparing the derived engine operating condition data with the engine stall condition-indicative data to output a third signal indicative of engine conditions known to lead to stalling with a high probability when the engine operating condition satisfies a predetermined relationship with the engine stall condition-indicative data, and fifth means, associated with an accessory device of an engine, for operating the accessory device in response to the third signal so as to increase the magnitude of the engine output torque relative to the load on the engine.

According to a further aspect of the invention, a stall preventive control system for an internal combustion engine comprises first sensors, each of which monitors a preselected engine operation parameter and produces a first sensor signal indicative thereof, second detector for detecting the operating state of a preselected engine operation-influencing vehicle component and producing a second detector signal indicative thereof, third means, associated with the first sensors, for detecting engine operating conditions on the basis of the first sensor signals and producing an engine stall-indicative third signal when engine conditions known to lead to stalling are detected, fourth means, responsive to the third signal, for recording the values of the first sensor signals and the second detector signal as an engine stall condition representative data set, the fourth means recording a engine stall condition representative data set upon every occurrence of the third signal, fourth means, responsive to the first sensor signals, for deriving engine operating condition data and comparing the derived engine operating condition data with the engine stall condition representative data and producing a fourth signal when the engine operating condition data satisfies a predetermined relationship with one set of the engine stall condition representing data, and fifth means, responsive to the fourth signal, for performing a predetermined engine stall preventive operation which increases the engine output torque factor relative to the load on the engine.

According to a still further aspect of the invention, a stall preventive control system for an internal combustion engine comprises a first sensor for producing an engine speed indicative first sensor signal, a reference signal generator for producing a second signal representative of an engine speed low enough to lead to engine stalling, second means for comparing the first sensor signal value with the second signal and producing an engine stall indicative signal if the first sensor signal value is less than the second signal value, an auxiliary drive unit responsive to the engine stall indicative signal for transmitting torque to the engine in order to increase the engine output torque relative to the load on the engine.

According to a still further aspect of the invention, a method for controlling an internal combustion engine comprises the steps of:

monitoring a preselected engine operation parameter;

detecting engine operating conditions on the basis of the monitored engine operation parameter;

detecting engine conditions known to lead to stalling on the basis of the detected engine operating condition;

recording the engine operation parameter at a moment the engine stall condition is detected as engine stall condition representative data, and accumulating another set of engine stall condition representative data each time the engine stall condition is detected; and comparing detected engine operating conditions with the engine stall condition representative data and performing a predetermined engine stall-preventive operation, in which the engine output torque is increased relative to the load on the engine, when the detected engine operating condition satisfies a specific relationship with at least one set of the engine stall condition representative data.

According to a still further aspect of the invention, a method for performing stall preventive control for an internal combustion engine, comprises the steps of:

monitoring an engine operating parameter;

detecting engine operating conditions on the basis of the detected engine operating parameter;

detecting an engine condition known to lead to engine stalling on the basis of detected engine operating conditions; and driving an auxiliary drive unit associated with the engine so as to apply additional torque to the engine when the engine stalling condition is detected.

According to a still further aspect of the invention, a method for projecting the possible occurrence of engine stall during engine operation, comprises the steps of:

monitoring variations in engine operation parameters;

detecting engine operating conditions on the basis of engine operating parameters;

detecting engine conditions known to lead to engine stalling on the basis of detected engine operating conditions;

recording the pattern of variation of the engine operation parameters each time the engine stalling condition is detected; and comparing the monitored variations of the engine operating parameters with the set engine operation parameter variation patterns to detect engine conditions which may lead to engine stall.

BRIEF DESCRIPTION OF THE DRAWINGS

The present invention will be understood more fully from the detailed description given herebelow and from the accompanying drawings of the preferred embodiment of the present invention, which, however, should not be taken to limit the invention to the specific embodiments but are for explanation and understanding only.

In the drawings.

DESCRIPTION OF THE PREFERRED EMBODIMENT

Figure 1A:
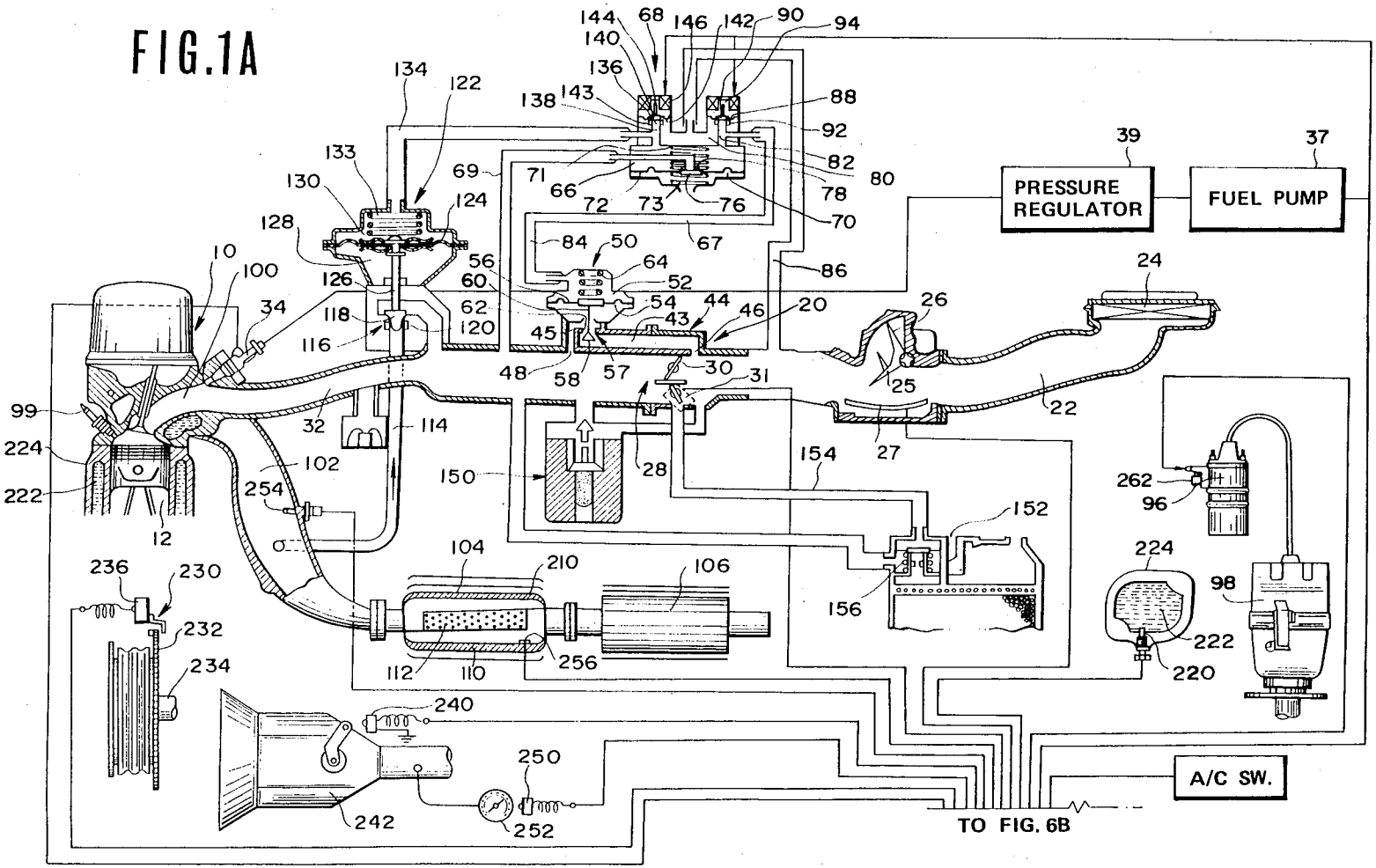
FIGS. 1A and 1B are diagrams of the overall structure of the first embodiment of an electronic automotive engine control system according to the present invention, which control system includes a feature for projecting probable engine operation patterns.

Referring now to the drawings, particularly to FIG. 1, the first embodiment of an electronic automotive engine control system according to the present invention generally comprises a controller 1000. The controller 1000 comprises a microprocessor and is associated with another microprocessor 2500 which serves as a vehicle information system. The engine control system 1000 includes various sensors and detectors such as an engine speed sensor, an air flow meter, and various temperature sensors, for providing control parameters, a control unit and actuators for controlling various engine operations such as fuel metering, idle air flow, and spark ignition timing. The engine control system further includes a fault monitor for detecting faults in the control system. The fault monitor checks the operation of the control unit and the inputs from the sensors. The results of the check operation in the fault monitor are conducted to a non-volatile memory 1450 which is associated with the engine control system 1000. The check operation results are also fed to a display 1900 for control system fault indication through a data line 2022. On the other hand, the vehicle information system 2500 in the shown embodiment is adapted to compute travelling distance, travelling time, average vehicle speed and so on in order to display information related to the current vehicle trip. The vehicle information system 2500 is associated with an external input unit 2540 such as a keyboard and a display 2520 for information display. The vehicle information system 2500 is further associated with a non-volatile memory 2530 for storing the computed results.

In the shown embodiment, the non-volatile memories may be of Metal-Nitride-Oxide-Silicon (MNOS), Erasable Programable ROM (EPROM) or CMOS technologies. In addition, the display can comprise various elements for indicating or warning when the system or sensors malfunction.

The engine control system 1000 and the vehicle information system 2500 are connected to each other via a data transmission line 2600. The vehicle information system 2500 produces a read command when a read request is inputted to the input unit. The read command is fed to the engine control system through the data transmission line 2600 to read the data out of the non-volatile memory 1450. The read request is inputted to the input unit when the display 1900 indicates an error in the engine control system 1000.

The data from the non-volatile memory 1450 is transferred to the vehicle information system 2500 via the fault monitor in the engine control system 1000 and the data transmission line 2600. The vehicle information system 2500 distinguishes which sensor or element of the control unit in the engine control system is malfunctioning. Based on the detection of the faulty element or sensor, the vehicle information system 2500 feeds a fault display signal to the display 2520. Therefore, in response to the fault display signal and in accordance with the fault display signal value, the display 2520 indicates the faulty sensor or element and the degree of error thereof.

It should be appreciated that the fault monitor outputs data in response to the read command and holds the check program results until the next read command is received. In addition, the fault monitor connected in this manner to the vehicle information system according to the present invention is applicable not only to the foregoing engine control system but also to electronic control systems for automatic power transmission or for anti-skid control and so forth.

FIG. 1 illustrates the electronic engine control system, so-called Electronic Concentrated Control System (ECCS) for a 6-cylinder reciprocating engine known as a Datsun L-type engine. In the shown control system, fuel injection, spark ignition timing, exhaust gas recirculation rate and engine idling speed are all controlled. Fuel pressure is controlled by controlling fuel pump operation.

In FIG. 1, each of the engine cylinders 12 of an internal combustion engine 10 communicates with an air induction system generally referred to by reference numeral 20. The air induction system 20 comprises an air intake duct 22 with an air cleaner 24 for cleaning atmospheric air, an air flow meter 26 provided downstream of the air intake duct 22 to measure the amount of intake air flowing therethrough, a throttle chamber 28 in which is disposed a throttle valve 30 cooperatively coupled with an accelerator pedal (not shown) so as to adjust the flow of intake air, and an intake manifold 32. The air flow meter 26 comprises a flap member 25 and a rheostat 27. The flap member 25 is pivotably supported in the air intake passage 20 so that its angular position varies according to the air flow rate. Specifically, the flap member 25 rotates clockwise in FIG. 1 as the air flow rate increases. The rheostat 27 opposes the flap member 25 and generates an analog signal with a voltage level proportional to the intake air flow rate. The rheostat 27 is connected to an electrical power source and its resistance value is variable in correspondence to variation of the angular position of the flap member 25 depending in turn on variation of the air flow rate.

Though a flap-type air flow meter has been specifically illustrated, this can be replaced with any equivalent sensor, such as a hot wire sensor or a Karman vortex sensor, for example.

A throttle angle sensor 31 is associated with the throttle valve 30. The throttle angle sensor 31 comprises a full-throttle switch which is closed when the throttle valve is open beyond a given open angle and an idle switch which is closed when the throttle valve is open less than a minimum value.

A throttle switch of this type is illustrated in the European Patent First Publication No. 0058826, published on Sept. 1, 1982.

Fuel injection through the fuel injectors 34 is controlled by an electromagnetic actuator (not shown) incorporated in each fuel injector. The actuator is electrically operated by the fuel injection control system which determines fuel injection quantity, fuel injection timing and so on in correspondence to engine operating conditions determined on the basis of measured engine operation parameters such as engine load, engine speed and so on. The fuel injector 34 is connected to a fuel pump 37 through a fuel feed line including a pressure regulator 39. The fuel pump 37 is controlled by means of a fuel pump relay 35. If necessary, fuel pressure may be controlled in the manner described in the co-pending U.S. patent application Ser. No. 355,157, filed on Mar. 5, 1982, now U.S. Pat. No. 4,497,300, which is a continuation application of U.S. patent application Ser. No. 101,548 now abandoned, which corresponds to German Patent First Publication (DE-OS) No. 29 49 988.5, published on July 31, 1980. The contents of the above-identified application is hereby incorporated by reference for the sake of complete disclosure. In the alternative, the fuel pressure may be controlled in the manner described in the co-pending U.S. patent application Ser. No. 655,554 filed on Sept. 28, 1984, now U.S. Pat. No. 4,577,604, and entitled CONTROL SYSTEM FOR FUEL PUMP FOR INTERNAL COMBUSTION ENGINE, the Japanese counterpart of which is now pending under Japanese Utility Model Application No. 58-52096. The contents of this co-pending application is also hereby incorporated by reference for the sake of disclosure.

It should be noted that, although the fuel injector 34 is disposed in the intake manifold 32 in the shown embodiment, it is possible to locate it in the combustion chamber 12 in a per se well-known manner.

An idle air or an auxiliary air intake passage 44 is provided in the air induction system 20. One end 46 of the idle air intake passage 44 opens between the air flow meter 26 and the throttle valve 30 and the other end 48 opens downstream of the throttle valve 30, near the intake manifold 32. Thus the idle air intake passage 44 bypasses the throttle valve 30 and connects the upstream side of the throttle valve 30 to the intake manifold 32. An idle air control valve, generally referred to by reference numeral 50, is provided in the idle air intake passage 44. The idle air control valve 50 generally comprises two chambers 52 and 54 separated by a diaphragm 56. The idle air control valve 50 includes a poppet valve 58 disposed within a port 57 so as to be movable between two positions, one allowing communication between the upstream and downstream sides 43 and 45 of the idle air intake passage 44 and the other preventing communication therebetween. The idle air intake passage 44 is thus separated by the idle air control valve 50 into two regimes 43 and 45 respectively located upstream and downstream of the port 57 of the idle air control valve. The poppet valve 58 has a stem 60 which is secured to the diaphragm 56 so as to move therewith. The diaphragm 56 is biased downwards in the drawing, so as to displace the poppet valve 58 from a valve seat 62, by a helical compression coil spring 64 disposed within the chamber 52 of the valve means 50. Thereby, the idle air control valve 50 is normally opened, and normally connects the regimes 43 and 45 of the idle air intake passage 44 to one another, via its valve port 57.

The chamber 54 of the idle control valve 50 is open to the atmosphere. On the other hand, the chamber 52 of the idle air control valve 50 communicates through a vacuum passage 67 with a pressure regulating valve 68 serving as the control vacuum source. The pressure regulating valve 68 is separated generally into two chambers 66 and 70 by a diaphragm 72. The chamber 66 of the pressure regulating valve 68 also communicates with the downstream side of the throttle valve 30 through the vacuum passage 69 so as to reflect the level of the intake vacuum. The chamber 70 is open to the atmosphere in a per se well-known manner. To the diaphragm 72 is secured a valve member 76 which opposes a valve seat 78 provided at the end of the passage 69. The chambers 66 and 70 receive helical compression springs 71 and 73 respectively. The position at which the springs 71 and 73 balance each other is referred to as the neutral position of the diaphragm 72. It will be noted that the chamber 66 can also be connected to an exhaust gas recirculation (EGR) rate control valve 116 which recirculates a fraction of the exhaust gas from an exhaust gas passage and exhaust gas recirculation passage to the intake manifold 32.

The diaphragm 72 moves upwards or downwards according to changes in the balance between the vacuum in the chamber 66 and the atmospheric pressure introduced into the chamber 70. This movement of the diaphragm 72, moves the valve member 76 toward or away from the valve seat 78.

Another chamber 80 is also defined in the control valve 68, which chamber 80 communicates with the chamber 66 through a passage 82. The passage 82 is connected with the chamber 52 of the idle air control valve 50 through a control vacuum passage 84. On the other hand, the chamber 80 also communicates with the air intake passage 20 upstream of the throttle valve 30 through a passage 86 so as to be exposed to atmosphere. The chamber 80 is partitioned by a diaphragm 88 to which a magnetic valve member 90 is secured. The magnetic valve member 90 opposes a valve seat 92 formed at the end of the passage 82. Also, the magnetic valve member 90 opposes an electromagnetic actuator 94, the duty cycle of which is controlled by a control pulse signal generated by a controller 100. Depending on the amount of atmospheric pressure introduced into the passage 82 from the chamber 80, which is determined by the duty cycle of the electromagnetic actuator 94 which in turn is determined by the duty cycle of the control pulse signal, the control vacuum for controlling the opening degree of the valve member 58 of the idle air control valve 50 is regulated and supplied via the control vacuum passage 67.

Spark ignition plugs 99 are installed in each of the engine cylinders 12 to perform spark ignition at a controlled timing. Each ignition plug 99 is connected to a distributor 98 which receives high voltage power from an ignition coil 96. The distributor 98 is controlled by a spark advancer which advances or retards the spark ignition timing depending on engine operating conditions.

An exhaust system for the engine exhaust gas comprises an exhaust manifold 100, an exhaust duct 102, an exhaust gas purifier 104, a muffler 106 anad an exhaust vent 108. The exhaust manifold 100 opens toward the engine cylinders to draw engine exhaust gas therefrom. The exhaust duct 102 communicates with the exhaust manifold 100 and includes the exhaust gas purifier 104 and the muffler 106. In the shown embodiment, the exhaust gas purifier 104 comprises a purifier housing 110 and a three-way catalytic converter 112 disposed within the purifier housing 110. The three-way catalytic converter 112 oxidizes monoxide carbon CO and hydrocarbons HC and reduces oxides of nitrogen $NO_x$.

An exhaust gas recirculation passage 114, which will be referred to hereafter as the EGR passage, is connected to the exhaust duct 102 upstream of the exhaust gas purifier 104. The EGR passage 114 communicates with the intake manifold 32 via an exhaust gas recirculation rate control valve 116 which will be referred as the EGR control valve. The EGR control valve 116 generally comprises a valve member 118 with a valve seat 120 form in the end of the EGR passage 114 adjacent the intake manifold 32. The valve member 118 is associated with a vacuum actuator 122 and is cooperatively connected to a diaphragm 124 of the vacuum actuator 122 via a stem 126. The diaphragm 124 divides the interior of the vacuum actuator 122 into two chambers 128 and 130. The chamber 128 communicates with the EGR passage 114 via a passage 132 and the chamber 130 communicates with the regulating valve 68 via a control vacuum passage 134. A set spring 133 for biassing the diaphragm 124 is disposed within chamber 130. The control vacuum passage 134 is connected to a passage 136 connecting the vacuum chamber 66 to a chamber 138. One end of the passage 136 faces a valve member 140 secured to a diaphragm 142. A valve seat 143 is formed in the end of passage 136 to allow the valve member 140 to selectably seal passage 136. The valve member 140 has a stem 144 projecting into an electromagnetic actuator 146.

The duty cycle of the electromagnetic actuator 146 is controlled to move the valve member 140 with respect to the valve seat 143 in response to a control signal generated by a controller to be described later. According to the instantaneous position of the valve member 140, intake air is admitted to the passage 136 via the passage 86 at a controlled rate. The intake air admitted into the passage 136 is mixed with the intake vacuum admitted from intake passage 20 downstream of the throttle valve 30 via the vacuum induction passage 69 into the vacuum chamber 66, so as to produce the control vacuum. The control vacuum thus produced is conducted to the chamber 130 of the actuator 122 via the control vacuum passage 134 to control the operation of the EGR control valve 116. Thereby, the exhaust gas is admitted into the intake manifold at a controlled rate.

An air regulator 150 is provided near the throttle chamber 28 for regulating the intake air flowing through the throttle chamber. Also, a carbon canister 152 is provided. The carbon canister 152 retains hydrocarbon vapor until the canister is purged by air via the purge line 154 to the intake manifold when the engine is running. When the engine is idling, the purge control valve 156 is closed. Only a small amount of purge air flows into the intake manifold through the constant purge orifice. As the engine speed increases, and the ported vacuum becomes stranger, the purge control valve 156 opens and the vapor is drawn into the intake manifold through both the fixed orifice and the constant purge orifice. The carbon canister 152 can trap hydrocarbons due to the chemical action of the charcoal therein.

Figure 1B:
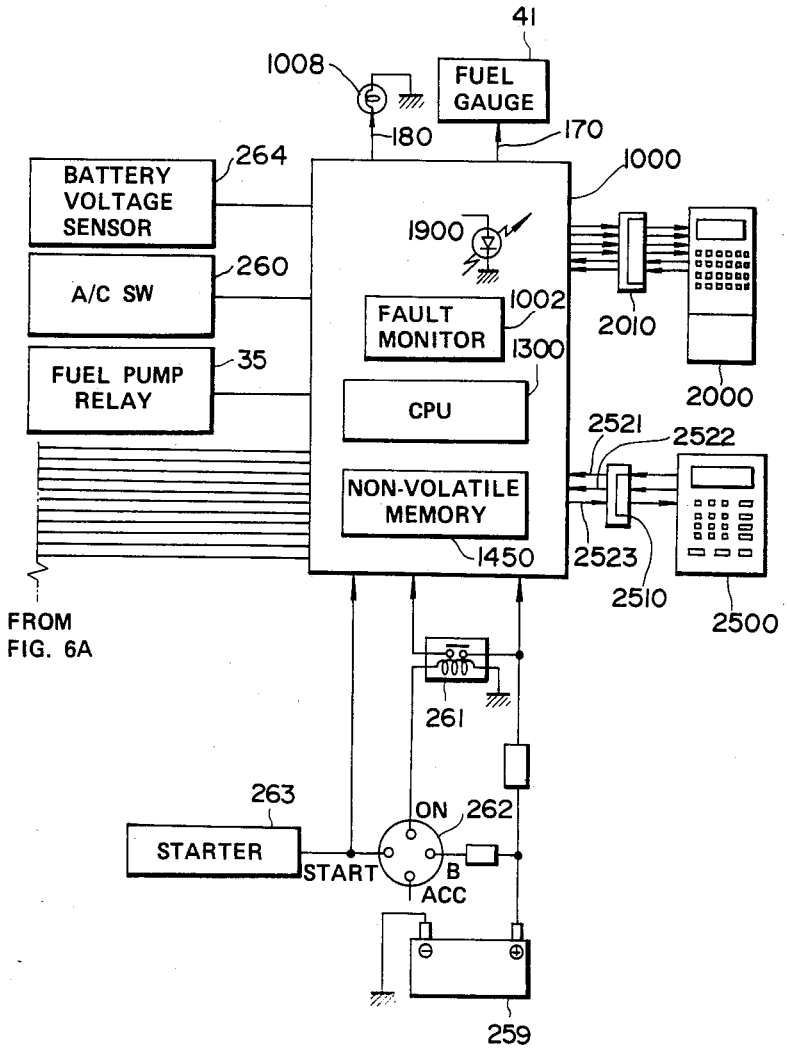

As shown in FIG. 1B, the controller 1000 generally comprises a microcomputer and controls a fuel injection system, a spark ignition system, an EGR system and engine idling speed. The controller 1000 is connected to an engine coolant temperature sensor 220. The engine coolant temperature sensor 220 is usually disposed within a coolant chamber 222 in an engine cylinder block 224 in order to measure the engine coolant temperature. The engine coolant temperature sensor 220 produces an engine coolant temperature signal $T_w$indicative of the measured engine coolant temperature. The engine coolant temperature signal $T_w$ is an analog signal with a voltage value proportional to the determined engine coolant temperature and is converted into a digital signal by a shaping circuit 1100 to adapt it for use by the digital controller 1001.

Generally speaking, the engine coolant temperature sensor 220 comprises a thermistor fitted onto a thermostat housing 226 provided in the coolant circulation circuit.

A crank angle sensor 230 is also connected to the controller 200. The crank angle sensor 230 generally comprises a signal disc 232 secured to a crank shaft 234 for rotation therewith, and an electromagnetic pick-up 236. The crank angle sensor 230 produces a crank reference angle signal and a crank position angle signal. As is well known, the crank reference angle signal is produced when the engine piston reaches the top dead center and the crank position angle signal is produced per a given unit of crank rotation, e.g., per 1 degree of crank rotation.

If necessary a spceial type of crank angle sensor such as is disclosed in the co-pending U.S. patent application Ser. No. 445,552, filed on Nov. 30, 1982, now U.S. Pat. No. 4,562,817, can be used. The contents of the above-identified co-pending U.S. patent application are hereby incorporated for the sake of disclosure. Also, if necessary, a timing calculation system described in the European Patent First Publication No. 00 85 909, published on Aug. 17, 1983 and the back-up system described in the European Patent First Publication No. 00 81 648, are applicable to the shown engine control system. The contents of these European Patent First Publications are hereby incorporated by reference for the sake of disclosure.

A transmission neutral switch 240 is connected to the controller 200. The transmission neutral switch 240 is secured to the transmission 242 to detect the neutral position thereof and produces a neutral signal when the transmission is in the neutral position.

Also, a vehicle speed sensor 250 is connected to the controller via a vehicle speed counter 204. The vehicle speed sensor 250 is located near a vehicle speed indicator 252 and produces a pulse train serving as a vehicle speed signal, the frequency of which is proportional to the vehicle speed.

An exhaust gas temperature sensor 256 is installed in the exhaust gas purifier housing 210. The exhaust gas temperature sensor 256 monitors the exhaust gas temperature and produces an analog signal as an exhaust gas temperature signal, the voltage of which is proportional to the exhaust gas temperature. The exhaust gas temperature signal is supplied to the controller 200 viaa the multiplexer 205 and the analog-digital converter 206 in which the exhaust gas temperature signal is converted into a digital signal suitable for use by the microcomputer 207. The digital signal indicative of the exhaust gas temperature has a frequency corresponding to the voltage of the exhaust gas temperature signal.

In addition, an exhaust gas sensor 254 such as an oxygen sensor, hereafter referred to simply as the $O_2$-sensor 254, is installed in the exhaust duct 102 upstream of the opening of the EGR passage 114. The $O_2$ sensor 254 monitors the concentration of oxygen in the exhaust gas. The output of the $O_2$ sensor goes high when the determined oxygen concentration exceeds a 1:1 ratio with other exhaust gas components and goes low when the oxygen concentration is less than a 1:1 ratio. The output of the $O_2$ sensor is inputted to the microcomputer 207 via the multiplexer 205 and the analog-digital converter 206 as a λ-signal.

In addition, the air flow meter 26 is connected to the controller 200. The rheostat 27 of the air flow meter 26 outputs an analog signal with a voltage proportional to the intake air flow rate. The throttle angle sensor 31 is also connected to the microcomputer 207 to supply the outputs of the full-throttle switch and the idle switch.

As shown in block form in FIG. 1B, the microcomputer 207 is also connected with an air-conditioner switch 260, a starter switch 262, an ignition switch 263 and a battery voltage sensor 264. The air-conditioner switch 260 is closed when the air-conditioner is operating. Also, the starter switch 262 is closed when the starter is operating. The battery voltage sensor 264 monitors the vehicle battery voltage and produces an analog signal with a voltage proportional to the determined battery voltage. The battery voltage signal is fed to the microcomputer 207 via the multiplexer 205 and the analog-digital converter 206.

In the shown embodiment, the controller 200 controls the fuel injection amount and timing, the spark ignition timing, the EGR rate and the engine idling speed.

The $O_2$ sensor signal from the $O_2$ sensor 254 is used to control the fuel injection quantity under stable engine conditions as determined with reference to the engine speed from the engine speed counter 203, the throttle valve angle position detected by the throttle angle sensor 31, the vehicle speed from the vehicle speed counter 204 and so on. Under stable engine conditions, the fuel injection quantity is feedback controlled on the basis of the $O_2$ sensor signal so that the air/fuel ratio can be controlled to the stoichiometric value. This method of fuel injection control is called λ-control. If the engine is running under unstable conditions, the fuel injection quantity is generally determined on the baiss of engine speed and intake air flow rate, the latter of which can be replaced by intake vacuum pressure downstream of the throttle valve. Under unstable engine conditions, the basic fuel injection quantity determined on the basis of engine speed and air flow rate is corrected according to other parameters such as air-conditioner switch position, transmission gear position, engine coolant temperature and so on.

The spark ignition timing is generally controlled on the basis of engine speed, air flow rate, engine coolant temperature and so on, which effect to varying degrees the advance and retard of the spark advance.

The EGR control is effected on the basis of engine speed, engine coolant temperature, ignition switch position and battery voltage. The recirculation rate of the exhaust gas is derived from the engine speed and a basic fuel injection quantity determined according the engine speed and engine load. The duty cycle of the EGR control valve is thus controlled in accordance with the determined recirculation rate.

The idle engine speed is controlled predominantly on the basis of engine coolant temperature and engine load condition. Under relatively cold engine conditions, the engine speed is maintained at a predetermined value, determined with reference to the engine coolant temperature, resulting in fast idle operation. In the normal temperature range, the engine speed is feedback-controlled on the basis of the difference between the actual engine speed and a reference engine speed determined on the basis of engine temperature, engine load condition and other parameters.

As shown in FIG. 1A and 1B, the controller 1000 also includes a fault monitor 1002. In practice, the fault monitor 1002 is a program stored in a memory 1004 and executed in a central processing unit (CPU) 1006. The controller 1000 is connectable with an external check unit 2000 via a check connector 2010. The check unit 2000 signals the controller 1000 to make the fault monitor operative in order the check a series of check items identified by inputs. this external check unit 2000 has been described in Japanese Patent Prepublication No. 56-141534 published Nov. 5, 1981. The controller 1000 is also connected to the vehicle information system 2500 via a connector 2510.

The fault monitor 1002 of the controller 1000 is connected to a fault indicator 1008 via line 180. The fault monitor 1002 produces a fault signal $S_f$ when an error occurs in any one of the check items. The fault indicator turns on in response to the fault signal $S_f$ to indicate malfunction of the engine control system. The fault monitor 1002 is associated with the non-volatile memory 1450 as set forth previously. Upon execution of the check program, check data from a series of check items are stored in the non-volatile memory 1450. When the fault indicator 1008 is turned on, the input unit 2540 of the vehicle information system generates and outputs the read request command to the engine control system in order to read the check data out of the non-volatile memory 1450. On the basis of the retreived check data, the vehicle information system 2500 feeds the fault display signal to the display 2520 in order to identify the specific fautly segment and error condition on the display.

Figure 2:
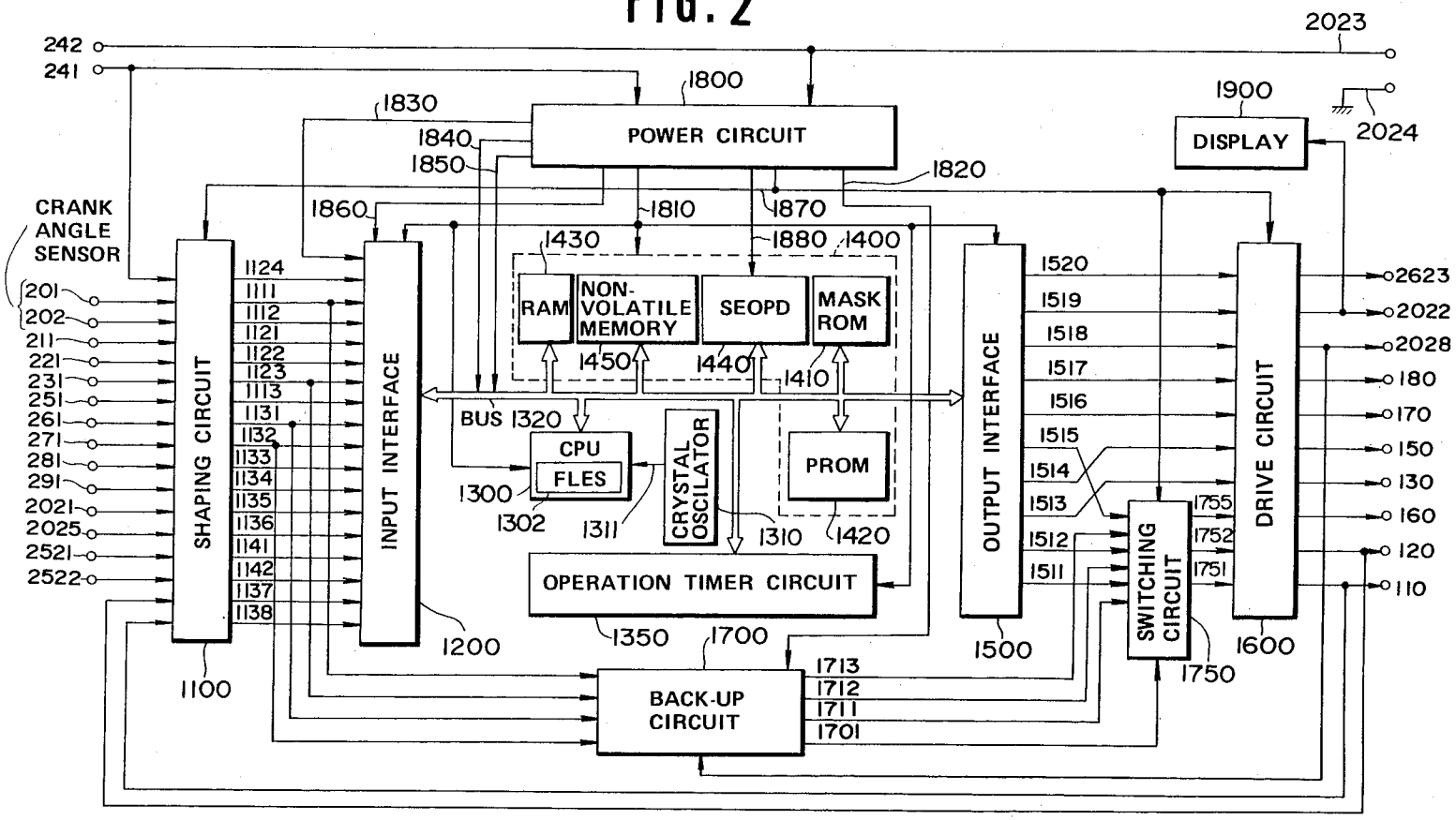
FIG. 2 is a block diagram of the first embodiment of the engine control system of FIG. 1.

FIG. 2 shows the controller 1000 of FIG. 1 in greater detail. The crank angle sensor 230, the vehicle speed sensor 250, the throttle angle sensor 31, the air-conditioner switch 260, the transmission neutral switch 240, the starter switch 262, the ignition switch 263, the air flow meter 26, the engine coolant temperature sensor 220, the exhaust gas sensor 254, the exhaust gas temperature sensor 256, the battery voltage sensor 264 are all connected to an input interface 1200 of the digital controller 1000 via a signal shaping circuit 1100. The shaping circuit 1110 eliminates noise in the sensor signals, absorbs surge voltages and shapes respective sensor signals. The interface 1200 includes a crank reference signal counter, an engine speed counter, a vehicle speed counter and analog-to-digital (A/D) converter with multiplexer. The crank reference signal counter and the engine speed counter are both connected to the crank angle sensor 230 to receive therefrom the crank reference angle signal and the crank position angle signal respectively. The vehicle speed counter is adapted to count the pulses of the vehicle speed sensor signal to produce a digital value representative of the vehicle speed. The air flow meter 26, the engine coolant temperature sensor 220, the exhaust gas sensor 254, the exhaust gas temperature sensor 256, the battery voltage sensor 264 all produce analog signals and are connected to the analog-to-digital converter so that the corresponding analog signals can be converted to corresponding digital signals suitable for use in the digital controller 1000.

The interface 1200 further includes a clock generator for controlling interface operations of a time-sharing basis, and a register for temporarily storing the inputted sensor signal values.

As usual, the digital controller 1000 includes a central processing unit (CPU) 1300, a memory unit 1400 including random access memory (RAM) 1430 and programmable read-only memory (PROM) 1420, and an output interface 1500. As shown in FIG. 2, the memory unit 1400 also includes non-volatile memory 1450, a holding memory 1440 and a masked ROM 1410. The CPU 1300 is connected to a clock generator including a crystal oscillator 1310 for controlling CPU operations on an incremental time basis. The CPU 1300 is also connected to each segment of the memory unit 1400, the register of the interface 1200 and the output interface 1500 via bus line 1320. The CPU 1300 executes programs stored in the masked ROM 1410 and the PROM 1420 in conjunction with input data read out from the register in the interface 1200. The results of execution of the programs are transferred to the output interface 1500 through the bus line 1320 for output.

As set forth previously, the masked ROM 1410 holds predetermined programs and initial program data. The PROM 1420 also stores programs and program data which are chosen initially depending upon the model of the vehicle and the type of engine. The RAM 1430 can renewably store data during execution of the programs and hold the results to be outputted. The contents of the RAM 1430 are cleared when power is turned off via the ignition switch. As stated previously, the non-volatile memory 1450 also stores data for the fault monitor. The contents of the non-volatile memory 1450 are maintained even when the ignition switch is turned off.

The controller 1000 also includes an operation timer circuit 1350 for controlling arithmetic operation, execution of programs and initiation of interrupts of the CPU. The operation timer 1350 includes a multiplier 1351 for high-speed arithmetic operations, an interval timer for producing interrupt requests and a free-run counter which keeps track of the transition intervals between one engine control program and another in the CPU 1300 and the starting period of execution mode, so as to control the sequential execution of a plurality of control programs.

The output interface 1500 includes an output register which temporarily stores the output data and a signal generator which produces control signals either with duty cycles defining the results of execution of the control programs in the CPU 1300 or with on/off switching characteristics.

The signal generator of the output interface is connected to a drive circuit 1600. The drive circuit 1600 is a kind of amplifier for amplifying the output signals from the output interface and supplying the control signals to the actuators, such as fuel injectors 34, the actuator 94 for the idling speed control valve, and the actuator 146 for EGR control valve. The drive circuit 1600 is also connected to the display or indicator 1900 for fault indication, the external check unit 2000 and the vehicle information system 2500. The drive circuit 1600 is connected to the external check unit 2000 via the connector 2010 and data transmission lines 2023, 2022 and 2026. On the other hand, the drive circuit 1600 is connected to the vehicle information system 2500 via the connector 2510 and the data transmission lines 2521, 2522 and 2523.

A back-up circuit 1700 is connected to the shaping circuit 1100 to receive data therefrom. In practice, the back-up circuit 1700 is connected to data lines to receive the crank reference angle signal, the engine temperature signal, starter switch on/off signal and the throttle valve close signal. In turn, the back-up circuit 1700 is connected to the data lines 1755, 1752 and 1751 via data lines 1713, 1712, 1711 and 1701 and a switching circuit 1750 which is, in turn, connected to the output interface 1500 via data lines 1515, 1512 and 1511. On the other hand, the drive circuit 1600 is connected via the actuator line 2026 to the back-up circuit 1700. The back-up circuit 1700 is responsive to the fault indication signal from the drive circuit 1600 to produce a switching signal. The switching circuit 1750 normally establishes communication between the data lines 1513, 1512 and 1511 and the lines 1755, 1752 and 1751 for normal engine control operation. The switching circuit 1750 is responsive to the switching signal from the back-up circuit 1700 via the data line 1701 to connect the data lines 1713, 1712 and 1711 with the data lines 1755, 1752 and 1751 to control the fuel pump 260, the spark advancer 262 and the fuel injectors 34, respectively.

A power circuit 1800 is connected to a vehicle battery 262 via a power switch acting as a main power source to distribute power Vcc to the input interface 1200, CPU 1300, memory 1400, the output interface 1500 and so forth. The power circuit 1800 is also connected to the back-up circuit 1700. The power circuit 1800 produces a signal indicative of the ignition switch on/off positions and reset and halt signals for resetting the controller and temporarily disabling the controller 1000 respectively. The ignition on/off signal from the power circuit is fed to the input interface 1200 via a line 1830. On the other hand, the reset signal and the halt signal are fed to the bus-line 1320 via lines 1840 and 1850. The power circuit 1800 also supplies power to the input interface, the shaping circuit 1100, the drive circuit 1600 and the switching circuit 1750 via lines 1860 and 1870. The power circuit 1800 is also connected to an auxiliary power source which bypasses the power switch to supply power to holding memory 1440 even when the main power switch is turned off.

In the engine control system, the PROM 1420 stores various control programs for controlling engine operation. In addition, the PROM 1420 stores the check program for the fault monitor as one of its background jobs. The check program is executed whenever the CPU 1300 is not busy with the engine control programs. The results of execution of the check program are stored in the non-volatile memory 1450. The non-volatile memory 1450 has a plurality of addresses allocated for each of the check items. The check result data in the non-volatile memory 1450 are read out in response to a request from the input unit 2540 of the vehicle information system 2500 to provide indication or display data to the vehicle information system.

On the other hand, in order to check each check item, particularly for accurately checking input and output signals of the engine control system 1000, it is necessary to eliminate influence due to noise created by various vehicle devices, such as the ignition system. Therefore, the time spent checking each check item must be long enough to compensate for the influence of noise.

In the check program, the crank angle signals from the crank angle sensor 230, the engine coolant temperature signal from the engine coolant temperature sensor 220, the air flow meter signal from the air flow meter 26 and so forth are checked as input signals. On the other hand, the idle air control signal, the EGR control signal, the fuel injection control signal and so forth are checked as output signals. There are various ways to check the input and output signals. For example, the above-mentioned British Prepublication No. 2046964 discloses a check program for completely checking the electronic controller.

A checking procedure applicable to the engine control system as set forth above and equivalent systems has been described in British Patent First Publication, No. 2,125,578, published on Mar. 7, 1984, which corresponds to the co-pending U.S. patent application Ser. No. 405,426, filed Aug. 5, 1982, now abandoned.

On the other hand, the above-mentioned engine control system is so programmed as to set or update operation patterns of the specific engine from actual engine operation as indicated by the engine operation parameters sensed by the various sensors set forth above. The set operation pattern will be used to project engine behavior in terms of the corresponding control parameters. This engine operation pattern setting procedure will be described below with reference to FIG. 3 which shows the operation of the control system in the form of a block diagram.

The actual engine operation pattern is derived at a block 3100. In order to derive the actual engine operation pattern of the engine, the block 3100 receives as inputs the throttle position indicative signal from the throttle angle sensor 31, the air flow rate indicative signal from the air flow member 26, and the engine speed indicative signal derived from the crank position signal from the crank angle sensor 230. The throttle angle indicative signal values, the air flow rate indicative signal values and the engine speed indicative signal values are each sampled at given intervals over a given period to derive their respective variation patterns. The derived variation patterns are stored in a memory block 3101 in RAM as a series of relative values or amplitude, rather than as physical measurement readings. Throughout the disclosure, the variation patterns of the throttle position indicative signal value, the air flow rate indicative signal value and the engine speed indicative signal values will be referred to as "actual operation pattern data AOPD".

Recognition of an actual pertinent engine operating state is performed at a block 3400. In order to recognize this engine operating state presaging engine stall, the block 3400 receives as inputs the engine coolant temperature indicative signal from the engine coolant temperature sensor 220, the throttle position indicative signal from the throttle angle sensor 31, the air flow rate indicative signal from the air flow meter 26, the engine speed indicative signal, the air conditioner condition indicative signal from the air conditioner switch 260 and the transmission gear position indicative signal from the transmission neutral switch 240. As set forth above, the air conditioner position indicative signal and the transmission gear position indicative signal are binary, ON/-OFF-type signals. For instance, the air conditioner indicative signal value remains HIGH as long as the air conditioner is operating and the transmission gear position signal value remains low as long as the transmission gear is in any gear other than neutral and/or park. The block 3400 is adapted to detect unstable operating states of engine such as near-stall, acceleration, deceleration, or transmission gear shift. The actual engine operating parameter values recorded upon detection of an unstable state will be referred to as "actual engine operating condition data AEOCD".

The actual engine operation pattern data AOPD is fed to a block 3300, in which the projected engine operation pattern is derived. The block 3300 is also connected to a block 3200 for deriving an engine operation influencing parameter. The block 3200 receives the air conditioner position indicative signal from the air conditioner switch 260 and the transmission gear position indicative signal from the transmission neutral swtich 240. An engine operation influencing parameter, which will be referred to as "engine operation influencing parameter EOIP" is derived from the air conditioner position indicative signal and the transmission gear position indicative signal. The block 3300 receives the actual operation pattern data AOPD from the block 3100 and the engine operation influencing parameter EOIP from the block 3200. In the block 3300, possible variations in engine operation are projected on the basis of the actual operation pattern data and the engine operation influencing parameter. The block 3300 responds to changes in the engine operation influencing parameter EOIP by accessing an appropriate memory block in RAM to read previously set pattern data in terms of the engine operation influencing parameter EOIP and the actual operation pattern data AOPD. In practice, variation patterns of the throttle angle position, engine speed, intake air flow rate are projected in accordance with the engine operation influencing parameter, among others. The data representative of the variation patterns of the engine operating parameters will be referred to as "operating parameter variation data OPVD". If the operating parameter variation data OPVD are not initialized during vehicle assembly, the actual operation pattern data AOPD from the block 3100 may be set in the appropriate memory block in RAM as operating parameter variation data OPVD.

A block 3500 receives the actual operation pattern data AOPD and the actual engine operating condition data AEOCD from the block 3400. The block 3500 responds to specific preselected specific engine operating conditions such as engine stall, acceleration, deceleration, or transmission gear shift as indicated by the actual engine operating condition data AEOCD. The block 3500 becomes active when any of the specific engine operating conditions is indicated by the actual engine operating condition data. The block 3500 triggers the CPU to record the actual operation pattern data in a corresponding memory block among a plurality of memory blocks referred to as "pattern memory 1440" allocated for the actual operation pattern data of various engine operating conditions. In the pattern memory, some of pattern data is initially set during installation of the control system in the vehicle in the factory. The data corresponding to the actual operation pattern data AOPD arrayed in terms of the actual engine operating condition data AEOCD will be referred to as "set engine operation pattern data SEOPD".

The set engine operation pattern data SEOPD is sent to a block 3600 in addition to the pattern memory 1440. The block 3600 also receives the operating parameter variation data OPVD from the block 3300. The block 3600 projects possible future engine operation pattens of the basis of the set engine operation pattern data and the operating parameter variation data. In practice, projection of future engine operating patterns is made by reading out one group of the set engine operation pattern data SEOPD corresponding to or most closely corresponding to the engine operating parameters represented by the operating parameter variation data OPVD. The data projected by the block 3600 will be referred to hereafter as "projected engine operation pattern data PEOPD".

The projected engine operation pattern data PEOPD are used to correct various engine control signal values such as the fuel injection control signal, the ignition timing control signal, the EGR control signal, and the idling air or auxiliary air flow rate control signal derived in a block 3700. It should be appreciated that the block 3700 performs various engine control operations on the basis of the engine operating parameters. Procedures for deriving these control values are well known. For example, derivation of fuel injection amount is disclosed in U.S. Pat. No. 4,319,327, to Higashiyama et al. Another fuel injection amount control technique is disclosed in U.S. Pat. No. 4,459,670 to Yamaguchi et al. This fuel injection control also includes a fuel injection timing control. This fuel injection timing control is disclosed in European Patent First Publication No. 0084116, published on July 27, 1983. Spark ignition control includes spark ignition timing control, spark ignition advance control and dwell angle control. Such a spark ignition control system has been disclosed in U.S. Pat. No. 4,376,428, to Hata et al, for example. Auxiliary air flow rate control is discussed in U.S. Pats. Nos. 4,406,261, 4,345,557, 4,402,289, 4,406,262, 4,344,398 to Ikeura. Finally, idling speed control, including derivation of a mathematically obtained dynamic model for projecting possible engine idling variations, has been disclosed in German Patent First Publication (DE-OS) No. 33 33 392 published on Mar. 22, 1984, which corresponds to the co-pending U.S. patent application Ser. No. 532,555, filed on Sept. 15, 1983 now U.S. Pat. No. 4,492,195. The contents of the above-identified publications is hereby incorporated by reference for the sake of disclosure.

The control signal values derived in the block 3700 are corrected in accordance with correction values derived on the basis of the projected engine operation pattern data PEOPD in order to optimize engine performance and minimize fuel consumption and pollution by exhaust gas. Also, the control signal values derived by the block 3700 are corrected in terms of the projected engine operation pattern data PEOPD for prevention of engine stalling when the projected engine operation pattern data indicates the possibility of stalling. Engine stall prevention procedures will be described in greater detail hereafter with reference to FIGS. 4 to 14.

Figure 4:
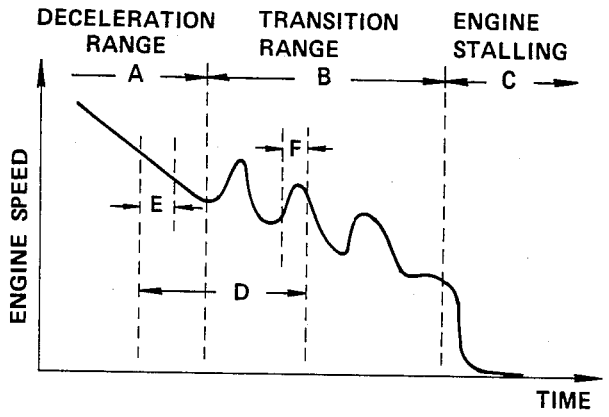
FIG. 4 shows a typical pattern of engine speed variation resulting in engine stalling.

FIG. 4 shows one typical pattern of variation of engine speed when the engine stalls. In DECELERATION RANGE A, the throttle valve may be fully closed or nearly closed so that intake air enters only through the auxiliary air passage. At the same time, fuel cut-off may be performed to conserve fuel. At the end of the range A, the clutch is released (in the case of manual power transmission) or the transmission is shifted to a lower gear ratio (in the case of automatic power transmission), so that the relative load on the engine is reduced to allow the engine to turn at a higher speed. If the engine including the air induction system, the fuel injection system, the exhaust system and so forth, are operating well, the transition between engine deceleration and engine idling may be relatively smooth. In this case, engine speed drop gradually and steady towards the set engine idling speed. In this case, engine stalling will never occur and thus engine stall preventive procedures need not be performed.

However, if the fuel supply system is not operating well, allowing the air/fuel mixture rate to deviate far from stoichiometry, cycle-to-cycle fluctuation of the engine output torque will occur. Similar fluctuations may occur when the release timing of clutch of the manual transmission or the shift-down timing of the automatic transmission is too late, spark ignition timing is retarded too much, or the air induction rate fluctuates due to deposition of carbon or the like on the inner surfaces of the induction passage. Cycle-to-cycle fluctuations in engine output torque may cause hunting of engine speed, as shown in the TRANSITION RANGE B. This sometimes results in engine stalling, as indicated in the "ENGINE STALLING" range C.

According to the present invention, variation of the engine speed during the range D in FIG. 4 is set in the pattern memory 1440 as stall-representative set engine operation pattern data SEOPD. In the shown example, the possibility of engine stalling is recognized upon detection of engine speed variations corresponding to the engine stall-representative set engine operation pattern data SEOPD. In order to prevent the engine from falling into engine stalling pattern, engine stall preventive procedure is to be performed taken during the interval D in FIG. 4. In this engine stall preventive procedure, the air conditioner switch is temporarily turned off, the air conditioner is temporarily disabled, or an auxiliary drive unit assisting the engine is activated to increase the relative torque of the engine.

In practice, the engine stall representative set engine operation pattern data SEOPD is recognized during the interval E and the engine stall preventive procedure is performed during the interval F.

Figure 5:
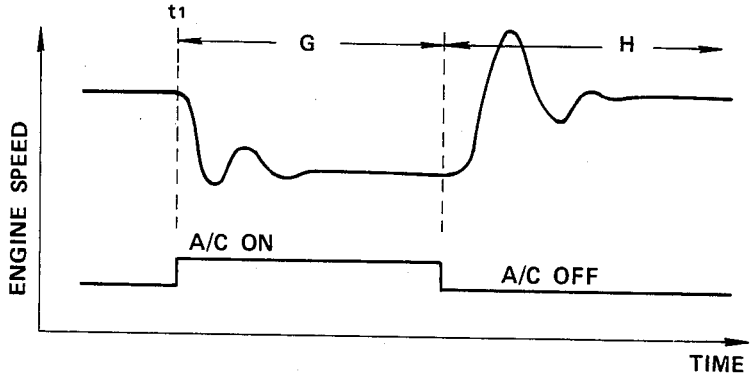
FIG. 5 shows the variation of engine speed in response to switching an air conditioner ON and OFF.

FIG. 5 shows typical engine speed variations in response to changes in air conditioner operating state. During an interval in FIG. 5, the air conditioner is operating and a clutch of a compressor of the air conditioner is in engaged to transmit engine output torque to the compressor. In this case, the compressor of the air conditioner acts as additional load on the engine. Due to this additional load, the engine speed remains relatively low. When the air conditioner is not operating or the air conditioner compressor clutch is disengaged, a reduced load or essentially no load is applied to the engine through the air conditioner compressor. As overall load applied to the engine is thus reduced, the engine speed raises increases, as shown at H in FIG. 5. This pattern of variation of the engine speed relative to the air conditioner operating state is recorded as the operating parameter variation data OPVD in RAM. This operating parameter variation data OPVD to be accessed in terms of the air conditioner condition will be referred to as "air conditioner dependent operating parameter variation data ACOPVD". It is assumed that engine speed will vary according to the pattern illustrated in the range G in response to closure of the air conditioner switch. On the other hand, engine speed variations according to the pattern illustrated in the region H in response to opening of the air conditioner switch can be expected. The air conditioner dependent operation parameter variation data ACOPVD are used as part of the engine stall preventive operation whenever conditions matching the engine stall representative set engine operation pattern data SEOPD are recognized.

Figure 6:
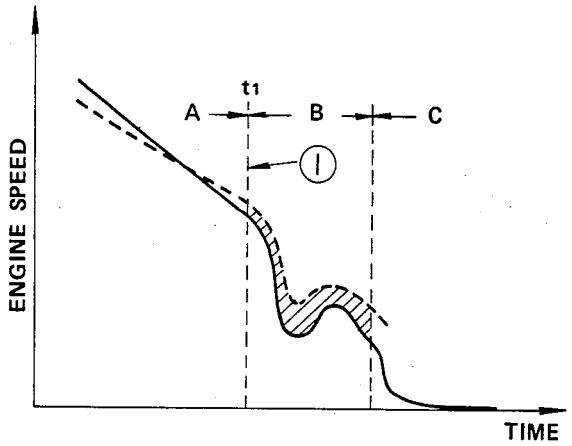
FIG. 6 illustrates a method of comparing a preset engine operation pattern with parameter variation data measured during engine operation.

FIG. 6 shows the relationship between the engine stall representative set engine operation pattern data SEOPD and the air conditioner dependent operation parameter variation data ACOPVD. Assume the engine speed is changing smoothly as illustrated by solid line a. When the air conditioner switch is turned ON at the time point $t_1$, air conditioner dependent operation parameter variation data ACOPVD as illustrated by the broken curve b is read out. The data SEOPD and ACOPVD are compared to calculate the area illustrated in hatching, which is representative of the integrated deviation therebetween. If area is smaller than a predetermined value, there is a high probability of engine stall if the stall preventive operation is not performed. Accordingly, the stall preventive operation is triggered. On the other hand, if the calculated area exceeds the predetermined value, the probability of engine stall is acceptably low. Therefore, in this case, stall preventive operation need not be performed.

Figure 14:
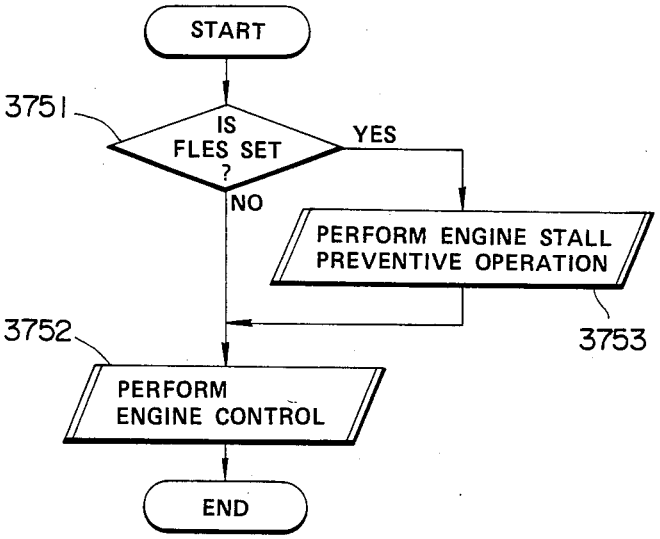
FIG. 14 is a flowchart of an engine stall-preventive program to be executed by the control system of FIG. 2.

FIGS. 8 to 14 are flowcharts of programs to be executed by the engine control system of FIGS. 1 and 2. As will be appreciated, the flowcharts of FIGS. 8 to 13 illustrate a sequence of routines for deriving the engine stall representative set engine operation pattern data to be used. The program formed by combining FIGS. 8 to 13 will be referred to as "engine operation projecting program". The program of FIG. 14 is executed to prevent the engine from stalling, and so will be referred to as "engine stall preventive program".

The engine operation projecting program is triggered at given intervals. The timing of execution of the engine operation projecting program is governed by the operation timer circuit 1350.

Figure 8:
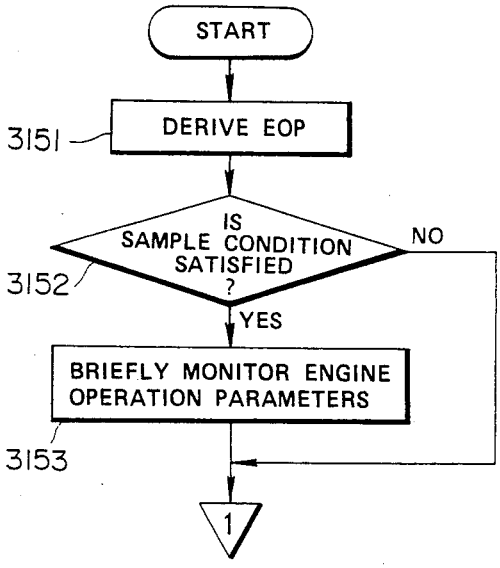
FIGS. 8 to 13 are a sequence of flowcharts of an engine operation pattern projecting program to be executed by the control system of FIG. 2, each figure showing the operation of one of the blocks in FIG. 3.
Figure 9:
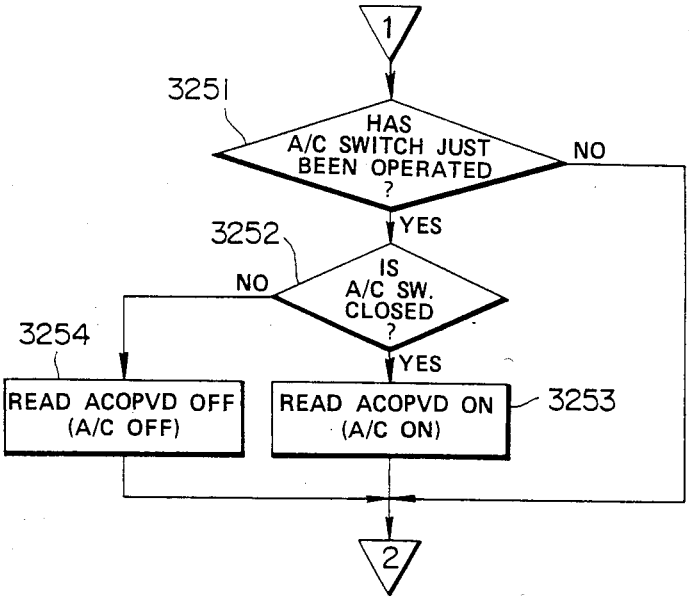
Figure 10:
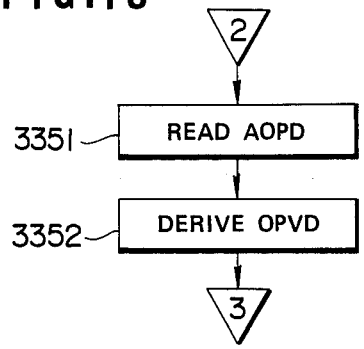
Figure 11:
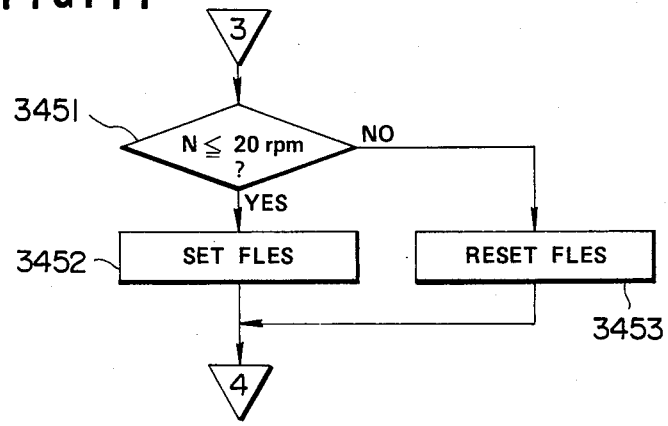
Figure 12:
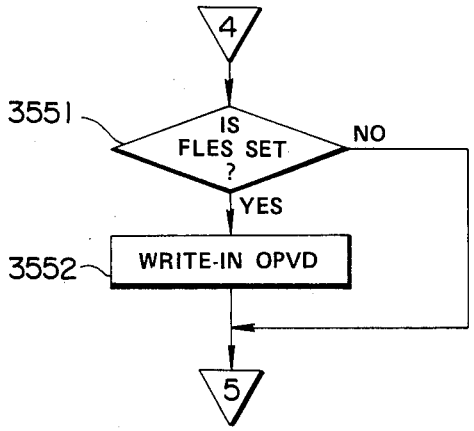
Figure 13:
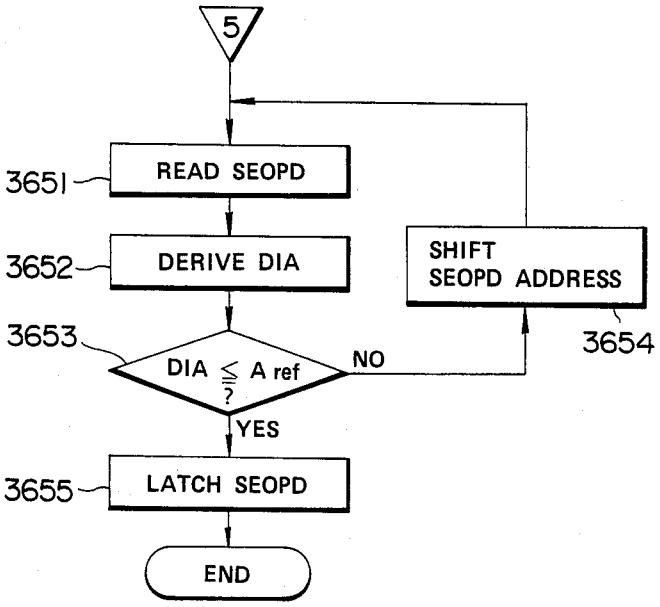

In this disclosure, the engine operation projecting program is separated into six portions which respectively correspond to the blocks 3100, 3200, 3300, 3400, 3500 and 3600. For instance, the routine in FIG. 8 represents the operation of the block 3100. Similarly, each of the routines shown in FIGS. 9 to 13 represent the operation of the blocks 3200, 3300, 3400, 3500 and 3600 respectively.

Immediately after starting execution of the engine operation projecting program, the actual engine operation pattern data AOPD is derived at a block 3151, as shown in FIG. 8. In this block, the throttle angle position indicative signal value St, the intake air flow rate indicative signal value Sq and engine speed indicative signal values Sn are processed to derive the actual engine operating condition. The engine operating pattern EOP derived in the block 3151 is checked against various preset patterns in ROM to judge whether the engine operating conditions merit comparison with variation patterns in the RAM, at a block 3152. If the engine operating pattern EOP matches one of the preset patterns, the input engine operating parameters are sampled repeated over a predetermined, short period of time to derive a variation pattern for each, at a block 3153.

Although the disclosure with respect to FIG. 3 recites that the block 3100 derives variation patterns and outputs pattern data for each of the input parameters, i.e. throttle angle variation, intake air flow rate variation and engine speed variation, hereinafter only the engine speed factor will be explained in detail for simplicity.

The sampled engine speed value to be used as the engine actual operation pattern data AOPD may be temporarily written in an appropriate register in CPU.

If the engine operation pattern does not match any of the preset patterns, the block 3153 is skipped. After skipping or executing the block 3153, control passes to a block 3251 of FIG. 9. From the block 3251, the operation of the block 3200 begins.

In the block 3251, the engine operation influencing parameter EOIP is checked. Though the operation of the block 3200 of FIG. 3 is described as to check the air conditioner position and the transmission gear position (transmission neutral position), for simplicity, only the air conditioner switch position will be considered in this description. Therefore, at the block 3251, the air conditioner switch 260 is checked to see whether or not the air conditioner switch 260 has just been operated. For instance, at the block 3251, the presence of a leading or trailing edge of an air conditioner switch signal pulse is checked for. If the air conditioner switch position remains unchanged, control passes to another routine for checking other engine operating influencing factors such as the transmission gear position.

If the air conditioner switch 260 has just been operated when checked at the block 3251, then the air conditioner switch 260 is checked to see if it has just been closed or opened, in a block 3252. If the air conditioner has just been closed, the memory block storing air conditioner dependent operation parameter variation data ACOPVD is accessed to read out the engine speed variation pattern specific to closure of the air conditioner switch, such as is illustrated in the range G of FIG. 5, at a block 3253. On the other hand, if the air conditioner switch 260 has just been opened, the air conditioner dependent operation parameter variation data ACOPVD representative of the engine speed variation pattern in response to opening of the air conditioner switch 260 such as is illustrated in the range H of FIG. 5 is read out from the corresponding area of RAM, at a block 3254.

Figure 3:
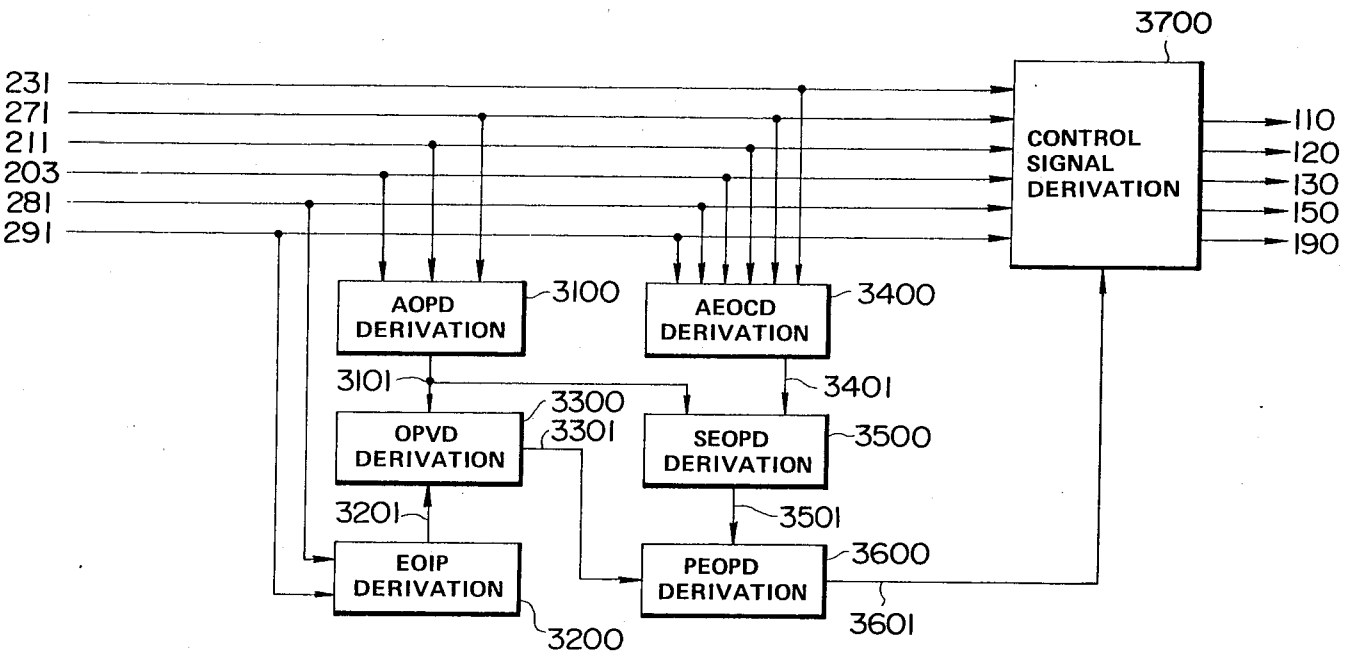
FIG. 3 is a block diagram of the operation of the control system of FIGS. 1 and 2.
Figure 7:
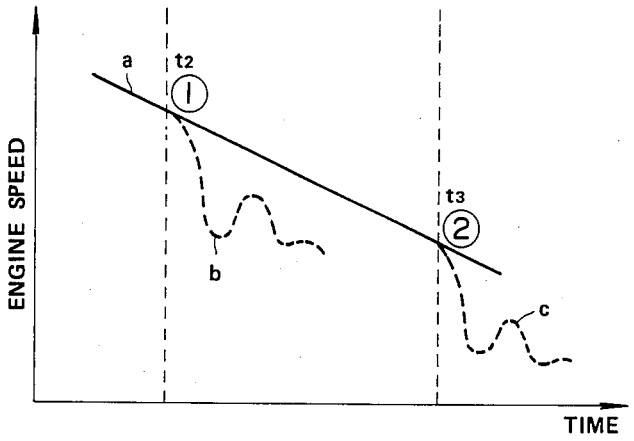
FIG. 7 shows a method of applying the projected engine operation pattern to actual control.

After execution of either of the blocks 3253 and 3254, control passes to a block 3351, corresponding to the block 3300 of FIG. 3. The engine speed variation data used as the actual operation pattern data AOPD is read out in the block 3351. The current engine speed value is added to each of the engine speed variation data to form a projected engine speed behavior curve from the normalized recorded data. Namely, in the block 3351, the engine speed at initial time points $t_2$ or $t_3$ in FIG. 7 are taken to be the initial engine speed values. The operating parameter variation data OPVD are then derived from the initial engine speed value obtained in the block 3351 and the air conditioner dependent operation parameter variation data ACOPVD, at a block 3352. This operating parameter variation data OPVD is illustrated in FIG. 7 by broken lines b and c.

In practice, derivation of the operating parameter variation data OPVD is performed by adding the air conditioner dependent operation parameter variation data ACOPVD derived in either the block 3253 or the block 3254 to the initial engine speed value in place of actual operation pattern data AOPD. This is because the engine stall operation involves only ON/OFF operations, such as switching off the air conditioner. In cases where, fuel supply or air flow are adjusted continuously to prevent stalling the full pattern data will be used for control over a specified period.

After execution of the block 3352, control passes to the block 3451 which corresponds to the block 3400. At the block 3451, the instantaneous engine speed N is checked to see if the speed is equal to or lower than 20 rpm. If so, engine stall is recognized and control passes to a block 3452. In the block 3452, an engine stall representative flag FLES is set in a flag register 1302 in CPU 1300. Otherwise, i.e. when the engine speed is higher than 20 rpm, the engine is recognized to be running and the engine stall representative flag FLES in the flag register 1302 is reset at a block 3453.

After execution of either the block 3452 or the block 3453, control passes to a block 3551, which corresponds to the block 3500. At the block 3551, the engine stall representative flag FLES is checked. If the engine stall representative flag FLES is set when checked in the block 3551, then the operating parameter variation data OPVD is stored in the pattern memory 1440, in a block 3552. After execution of the block 3552 or when the engine stall representative flag FLES is not set, control passes to a block 3651. In the block 3651, the memory blocks storing the engine stall representative set engine operation pattern data SEOPD are accessed in sequence. Each of the memory blocks storing the engine stall representative set engine operation pattern data will be referred to as a "SEOPD address".

In the first cycle of operation subsequent to execution of the block 3551 or 3552, the first SEOPD address is accessed to read the first engine stall representative set operation pattern data from the pattern memory 1440. In a block 3652, the read out pattern data SEOPD are compared with the operating parameter variation data OPVD described with reference to FIG. 5. In the block 3652, the hatched area in FIG. 5 is measured. The obtained area which will be hereafter referred to as "deviation indicative area DIA", is compared with a predetermined value Aref, at a block 3653. If the deviation indicative area DIA is equal to or less than the predetermined value Aref, then the pattern data SEOPD is latched at a block 3655. Otherwise, the SEOPD address to be accessed is shifted to the next one at a block 3654. Then, control returns to the block 3651 to read out the SEOPD data from the next SEOPD address. The blocks 3651, 3652, 3653 and 3654 form a loop to be repeated to check the operation parameter variation data OPVD against each SEOPD data pattern in sequence until the corresponding or the closest SEOPD pattern is found out.

When the engine stall-representative set operation pattern data matching or approximately matching the current operation parameter variation data OPVD is found at the block 3653, the pattern data SEOPD is latched at the block 3655. The engine operation projecting program then ends.

FIG. 14 shows the engine stall preventive operation which corresponds to part of the control operations performed by the block 3700. The program of FIG. 14 is executed in synchronism with engine rotation. In practice, the program is executed in response to each crank reference signal. At a block 3751, the engine stall representative flag FLES is checked. If the engine stall representative flag FLES is not set, normal engine control is performed at a block 3752. On the other hand, if the engine stall representative flag FLES is set, then control passes to a block 3753 in which the engine stall preventive operation is carried out.

In practical engine stall preventive operation, there are two ways to prevent the engine from stalling. One is to reduce the load on the engine. In order to reduce the load on the engine, the air conditioner can be temporarily disabled or an electromagnetic clutch used to connect and disconnect the compressor of the air conditioner unit can be temporarily disengaged, as set forth above. Temporary disablement of the air conditioner can be accomplished by means of a relay connected to the control system and energized by a disabling signal produced at the block 3753. In this case, the air conditioner remains disabled until the engine stall representative flag FLES is reset. As an alternative, the air conditioner may be disabled for a certain fixed period of time which may be determined experimentally.

To reduce the load on the engine, the alternator also be controlled to reduce generation of electric power. To achieve this, field current applied to the alternator may be reduced by means of a relay in the alternator circuit. The relay may be controlled by the signal produced at the block 3753. The engine load can also be reduced by reducing the indirect load such as the electrical load on the alternator. For example, the electrical accessories such as a blower motor of the air conditioner unit, a rear defogger, and/or an automotive audio unit, may be temporarily disabled without interfering with engine operation. Since such electric accessories are connected to the vehicle battery through an ACC terminal in the ignition switch assembly, a single relay can enable and disable all of the electrical accessories. Furthermore, engine load can also be reduced by reducing the power supply to the headlamps, wiper motor and so forth which cannot be disabled but can be operated at reduced power.

Another way to prevent engine stall is by means of devices which can be propelled independently of the engine to provide additional torque. For example, the starter motor can be used as an electric motor to provide additional engine torque. Similarly, the alternator can be used as an electric motor to drive the engine via the power transmission belt stretched between the alternator pulley and a pulley attached to the engine output shaft. Furthermore, an inertial flywheel can also be used as an engine drive assist device.

It should be appreciated that although the aforementioned example has been directed to recognition of possible engine stall by observing engine speed variations, intake air flow rate or engine lubrication oil pressure can be used to recognize unstable engine states. Furthermore, deceleration of the engine can be detected by the combination of the throttle angle sensor and the air flow sensor. Similarly, a pressure sensor installed in the air induction system may be used to detect engine deceleration.

In the foregoing first embodiment, not only the engine stalling state but also engine acceleration, deceleration, transmission gear shifting can be detected. Engine behavior in response to acceleration or deceleration demands or transmission gear shifting can be projected or extrapolated to adjust control signals in order to optimize engine operation and ensure smooth transitions and good drivability.

Figure 15:
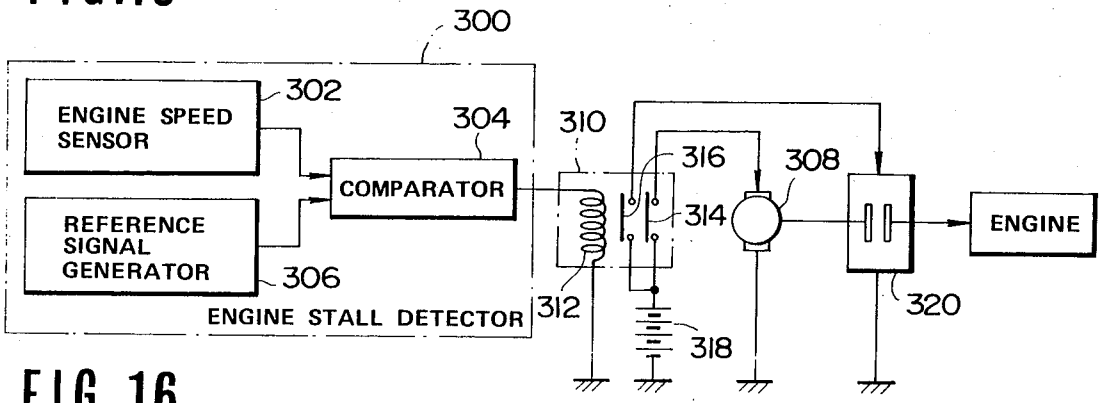
FIG. 15 is a block diagram of the second embodiment of engine stall-preventive engine control system according to the present invention.

FIG. 15 shows the second embodiment of the engine stall presentive engine control system according to the present invention. An engine speed sensor 302 is adapted to output an engine speed indicative signal, which may be a pick-up associated with a primary winding of an ignition coil (not shown), contact breaker (not shown) in an ignition circuit, or a crank angle sensor producing a pulse train, the frequency of which is proportional to the engine revolution speed. The engine speed sensor 302 is connected to a comparator 304. The comparator 304 is also connected to a reference signal generator 306 which is adapted to output a reference signal having a value representative of an engine stalling criterion. If the reference signal produced by the reference signal generator 306 is an analog signal having a voltage indicative of the reference value, then the engine speed sensor signal of pulse train form may be frequency-to-voltage converted before input to the comparator. The engine speed sensor 302, the reference signal generator 306 and the comparator 304 form an engine stall detector 300.

The comparator 304 of the engine stall detector 300 is connected to a starter motor 308 via a relay circuit 310. The relay circuit 310 includes a relay coil 312 connected to the comparator 304 and first and second contactors 314 and 316. The first contactor 314 is connected to the starter motor to connect a vehicle battery 318 to the starter motor when closed. The second contactor 316 is connected to an electromagnetic clutch 320. The starter motor 319 may be mechanically connected to the engine to drive the latter via the electromagnetic clutch 320 in a well-known manner. The second contactor 316 connects the electromagnetic clutch 320 to the battery 318 to engage the clutch when closed.

The circuit including the first and second contactor 314 and 316 to connect the battery 318 to the starter motor and the electromagnetic clutch may be independent of the starter circuit (not shown) which activates the starter motor and the electromagnetic clutch when an ignition switch (not shown) is moved to the START position.

The comparator 304 normally outputs a LOW-level signal to keep the relay coil 312 de-energized. When the engine speed indicative signal value drops equal to or below the reference signal value, the comparator output goes HIGH to energize the relay coil 312. Energization of the relay coil closes the first and second contactors 314 and 316. As a result, battery power is supplied to the starter motor 308. Revolution of the starter motor 308 is transmitted to the engine through the electromagnetic clutch 320 which is engaged by the power supplied through the second contactor 316. The relay coil 312 is de-energized by the LOW-level comparator output when the engine speed recovers to the level of the engine stall criterion represented by the reference signal value.

Figure 16:
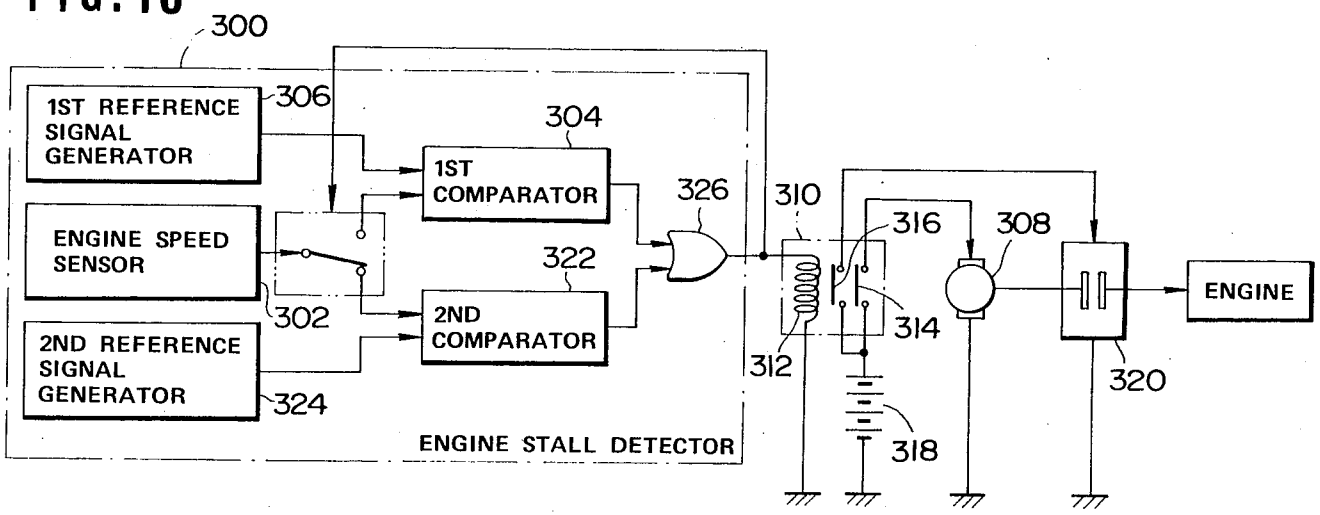
FIG. 16 is a block diagram of the third embodiment of engine stall-preventive engine control system according to the present invention.

If necessary, the starter motor 319 may be an auxiliary unit independent of the starter motor used to start the engine. Furthermore, a second comparator 322 associated with a second reference signal generator 324 may be employed, as shown in FIG. 16. In this case, the relay coil 312 is connected for input from the comparators 304 and 322 through an OR gate 326. The second reference signal generator 324 outputs a second reference signal having a value greater than that of the reference signal produced by the reference signal generator 306. A switch 328 selectively connects the engine speed sensor 302 to one of the comparators 304 and 322. This switch normally connects the engine speed sensor 302 to the comparator 304 but responds to a HIGH-level output from the OR gate by connecting the engine speed sensor 302 to the comparator 322.

In this modification, hysteresis is provided by driving the starter motor 308 until the engine speed exceeds the higher second reference value. This serves to prevent hunting in starter motor operation.

Figure 17:
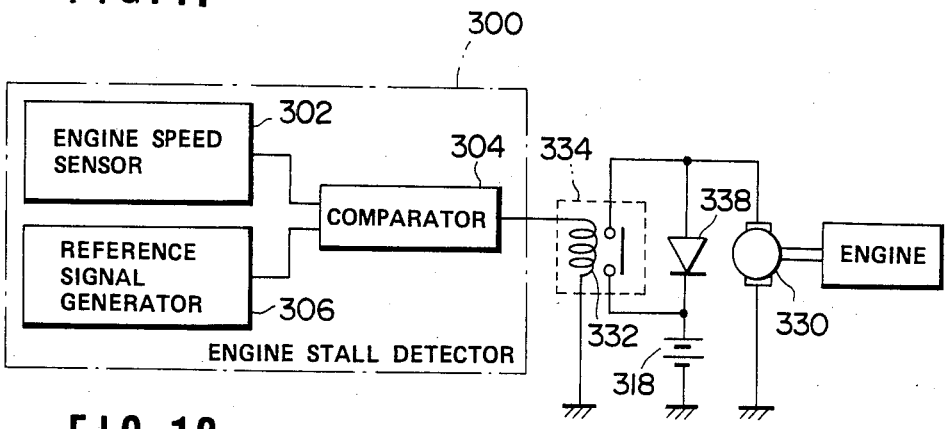
FIG. 17 is a block diagram of the fourth embodiment of engine stall-preventive engine control system according to the present invention.

FIG. 17 shows the third embodiment of the engine stall preventive engine control system according to the present invention. In this embodiment, the engine stall detector 300 is connected to an alternator 330 for recharging the vehicle battery 318 during normal engine operation. The comparator 304 of the engine stall detector 300 sends its output to a relay coil 332 in a relay circuit 334. A contactor 336 is connected in parallel to a diode 338, both of which connect the battery 318 to the alternator.

During the normal engine operation, electric power generator by the alternator 330 is applied to the battery 318 through the diode 338 to recharge the battery. On the other hand, when the possibility of engine stall is detected by the engine stall detector and thus the comparator output goes HIGH, the relay coil 332 is energized to close the contactor 336 to connect the battery 318 to the alternator 330 directly. At this time, the drop in engine speed below the engine stall criteria means that the power produced by the alternator will be relatively low, so that the battery power supplied to the alternator 330 will drive the latter to rotate. Since the alternator 330 is coupled to the engine output shaft, the rotational torque of the alternator 330 is transmitted to the engine output shaft to assist revolution of the engine. This will effectively increase the engine output torque and so prevent the engine from stalling.

Figure 18:
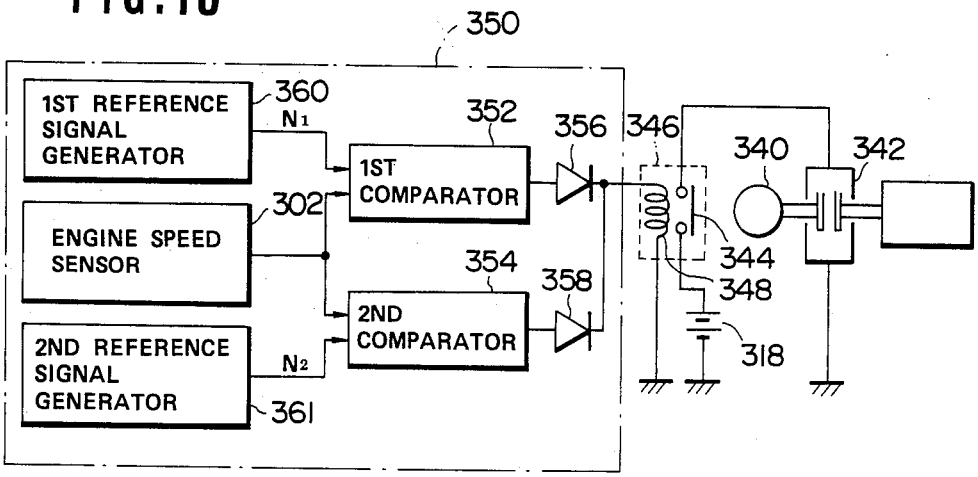
FIG. 18 is a block diagram of a modification of the second embodiment of the engine stall-preventive engine control system of FIG. 15.

FIG. 18 shows the fourth embodiment of the engine stall preventive engine control system according to the invention. In this embodiment, a flywheel 340 adapted to accumulate engine power is used to assist engine revolution when the possibility of engine stall is detected. The flywheel 340 is connected to the engine output shaft through an electromagnetic clutch 342. The electromagnetic clutch 342 is connected to the vehicle battery 318 through a contactor 344 of a relay circuit 346. A relay coil 348 of the relay circuit is connected to the engine stall detector 350.

The engine stall detector 350 comprises a pair of first and second comparators 352 and 352 connected to the relay coil 348 through diodes 356 and 358. Each of the first and second comparators 352 and 354 are connected to the engine speed sensor 302. On the other hand, the comparator 352 is connected to a first reference signal generator 360 outputting a first reference signal. The first reference signal has a value representative of an engine speed high enough to drive flywheel to accumulate the engine power. The second reference signal generator 354 produces the second reference signal having a value representative of the engine stall criterion.

In this construction, when the engine speed exceeds the first reference signal value, the output level of the first comparator 352 goes HIGH to energize the relay coil 348. Therefore, the contactor 344 is closed to apply the battery voltage to the electromagnetic clutch 342 to engage the latter. Engagement of the electromagnetic clutch 342 applies the engine ouput torque to the flywheel 330 to drive the latter. As is well known, the flywheel accumulates engine power in the form of angular momentum. On the other hand, the flywheel 330 may serve to regulate the engine output torque when engine output fluctuates.

When the engine speed drops equal to or lower than the first reference value, the output of the first comparator 352 goes LOW to deenergize the relay coil 348. As a result, the contactor 344 opens to disengage the electromagnetic clutch 342. Disengagement of the electromagnetic clutch 342 frees the flywheel 340 to rotate with its own accumulated angular momentum.

If the engine speed drops further below the engine stall criterion as represented by the second reference signal value, the output of the second comparator 354 goes HIGH. This causes energization of the relay coil 348 to supply the battery power to the electromagnetic clutch 342. As a result, the electromagnetic clutch 342 is engaged to connect the flywheel 340 to the engine output shaft. As the flywheel stores a relatively great amount of engine power, the engine is driven by the flywheel 340 to speed up to a level higher than the engine stall criterion.

A IGN terminal of an ignition switch assembly may be connected between the battery 318 and the contactor 344. This prevents the engine from being driven by the flywheel after the ignition switch is opened.

Figure 19:
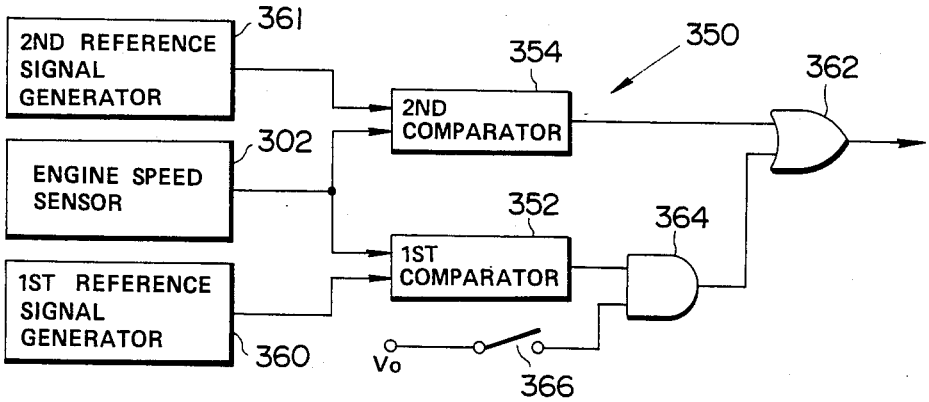
FIG. 19 is a block diagram showing a modification of an engine stall detector in the fourth embodiment of FIG. 18.

FIG. 19 shows a modification of the engine stall detector 350 of the fourth embodiment. In this modification, the second comparator 354 is connected to one input terminal of an OR gate 362. The other input terminal of the OR gate 362 is connected to the output terminal of an AND gate 364. One input terminal of the AND gate 364 is connected to the first comparator 352. The other input terminal of the AND gate is connected to a throttle-closed sensor 366.

In this construction, engine power is accumulated only when the engine speed is higher than the first reference signal value and while the throttle valve is fully closed or nearly closed. This prevents loss of engine output while the engine is accelerating and reduces the influence of the flywheel on the engine as an additional load to ensure good engine response and performance.

Figure 20:
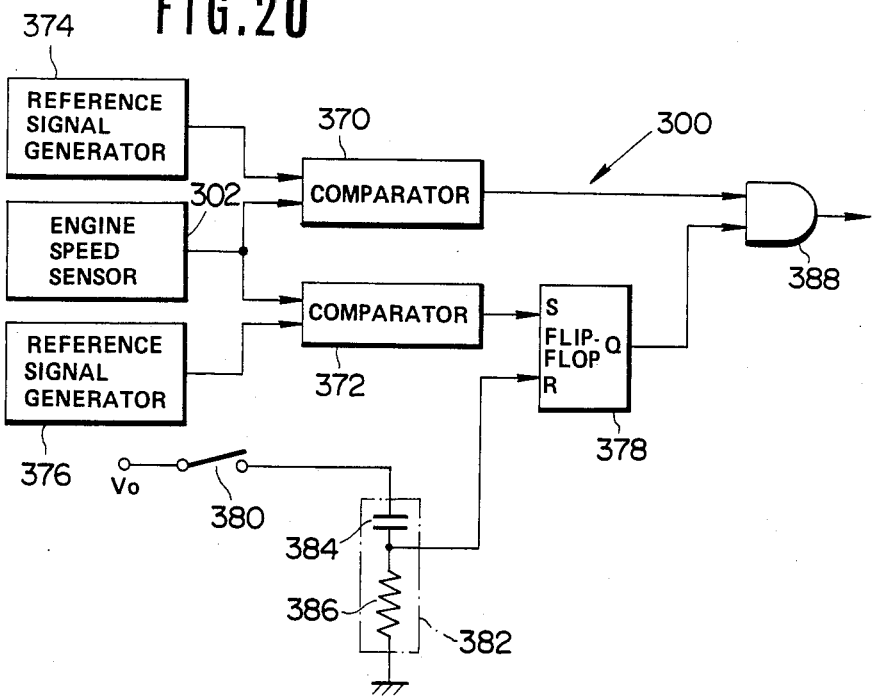
FIG. 20 is a block diagram of a modification of an engine stall detector in the second and third embodiment of FIGS. 15 to 17.

FIG. 20 shows a modification of the engine stall detector of the foregoing second and third embodiment. In the shown modification, the engine stall detector 300 comprises a main comparator 370 and an auxiliary comparator 372. The main comparator 370 is connected to a reference signal generator 374 which outputs the reference signal having a value representative of the engine stall criterion. On the other hand, the auxiliary comparator 372 is connected to another reference signal generator 376 which produces another engine start-up reference signal indicative of an engine speed indicative of self-sustaining operation. The auxiliary comparator 372 is connected to the set input terminal of a flip-flop 378. On the other hand, the reset input terminal of the flip-flop 378 is connected to a START terminal of an ignition switch assembly through a differentiation circuit 382 including a capacitor 384 and a resistor 386. With this arrangement, the flip-flop 378 is reset when engine cranking is requested by actuation of the ignition switch to START position. Subsequently, after the engine speed exceeds the engine start-up threshold, the flip-flop 378 is set by the HIGH-level output from the auxiliary comparator 372.

The main comparator 370 is connected to one input terminal of an AND gate 388 the other input terminal of which is connected to the output terminal of the flip-flop 378. AND gate 388 will be rendered conductive only after the engine has been started and thereafter the engine speed drops below the engine stall criterion. Therefore, the engine stall detector is disabled until the engine has been started. This prevents the engine stall detector from outputting an engine stall indicative signal as long as the engine is not running.

Figure 21:
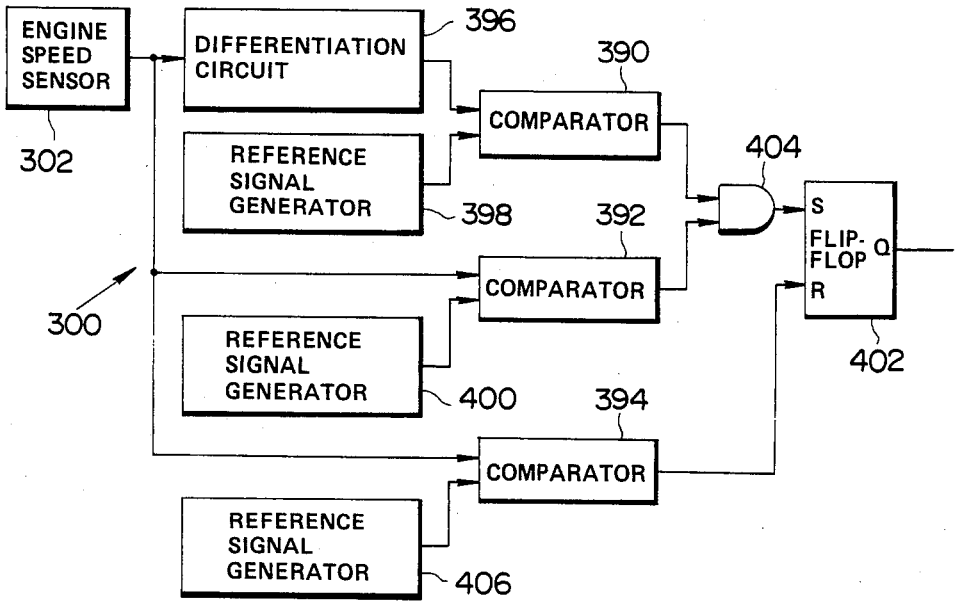
FIG. 21 is a block diagram of another modification of the engine stall detector in the second and third embodiments of FIGS. 15 to 17.

FIG. 21 shows another modification of the engine stall detector 300 in the foregoing second and third embodiments. In this modification, engine stall detector 300 comprises three comparators 390, 392 and 394. The comparator 390 is connected to the engine speed sensor 302 through a differentiation circuit 396 which outputs an engine acceleration and deceleration indicative signal by differentiating the engine speed signal. The comparator 390 is also connected to a refernece signal generator 398 which produces a reference signal indicative of a deceleration threshold. The comparator 392 is connected to the engine speed sensor 302 directly to a reference signal generator 400 producing a reference signal indicative of the engine stalling threshold. The comparators 390 and 392 are connected to the set input terminal of a flip-flop 402 through an AND gate 404.

The comparator 394 is connected to the engine speed sensor 302 and a reference signal generator 406 which is adapted to output a reference signal indicative of an engine speed recovery threshold. The comparator 394 is connected to the reset input terminal of the flip-flop 402.

In this arrangement, the flip-flop 402 is set when the engine deceleration is greater than the deceleration threshold and the engine speed is lower than the engine stall threshold. When set, the flip-flop 402 outputs a HIGH-level signal serving as the engine stall detector output. The flip-flop 402 is reset to output a LOW-level signal when the engine speed exceeds the engine recovery threshold.

It should be noted that procedures for operating the starter motor, the alternator flywheel as additional driving devices to aid engine operation for the purpose of engine stall prevention may be applied to the first embodiment. In this case, the engine stall detector 300 or 350 may be built into the engine control system of FIGS. 1 and 2. The engine control system may produce a drive signal to activate the relay and in turn the starter motor, alternator or flywheel. It is also possible to operate an auxiliary drive unit so as to reduce the engine load, such as by disabling the air conditioner unit.

As set forth above, according to the present invention, accidental engine stall can be successfully and satisfactorily prevented and thus all of the objects and advantages sought for the invention are fulfilled.

What is claimed is:

1. A stall preventive control system for an internal combustion engine comprising:

first sensors, each of which monitors a preselected engine operation parameter and produces a first sensor signal indicative thereof;

second detector for detecting the operating state of a preselected engine operation-influencing vehicle component and producing a second detector signal indicative thereof;

third means, associated with said first sensors, for detecting engine operating conditions on the basis of said first sensor signals and producing an engine stall-indicative third signal when engine conditions known to lead to stalling are detected;

fourth means, responsive to said third signal, for recording the values of said first sensor signals and said second detector signal as an engine stall condition representative data set, said fourth means recording a engine stall condition representative data set upon every occurence of said third signal;

fifth means, responsive to said first sensor signals, for deriving engine operating condition data and comparing said derived engine operating condition data with said engine stall condition representative data and producing a fourth signal when said engine operating condition data satisfies a predetermined relationship with one set of the engine stall condition representing data; and fifth means, responsive to said sixth signal, for performing a predetermined engine stall preventive operation which increases the engine output torque factor relative to the load on the engine.

2. A stall preventive control system for an internal combustion engine comprising:

a first sensor for producing an engine speed indicative first sensor signal;

a reference signal generator for producing a second signal representative of an engine speed low enough to lead to engine stalling;

second means for comparing a value of said first sensor signal with said second signal and producing an engine stall indicative signal if said first sensor signal value is less than said second signal;

an auxiliary drive unit responsive to said engine stall indicative signal for transmitting torque to the engine while the engine is operating under its own power in order to increase the engine output torque relative to the load on the engine, said auxiliary drive unit comprising a starter motor which is independent of another starter motor used for engine cranking and which is responsive to said engine stall indicative signal to temporarily apply additional torque to an engine output shaft.

3. A stall preventive control system for an internal combustion engine comprising:

a first sensor for producing an engine speed indicative first sensor signal;

a reference signal generator for producing a second signal representative of an engine speed low enough to lead to engine stalling;

second means for comparing said first sensor signal value with said second signal and producing an engine stall indicative signal if said first sensor signal value is less than said second signal value;

an auxiliary drive unit responsive to said engine stall indicative signal for transmitting torque to the engine while the engine is operating under its own power in order to increase the engine output torque relative to the load on the engine, comprising an alternator for generating electric power, also operative as an electrically driven motor, and responsive to said stall indicative signal to operate as an electrically driven motor to apply torque to the engine.

4. A method for controlling an internal combustion engine comprising the steps of:

monitoring a preselected engine operation parameter;

detecting engine operating conditions on the basis of the monitored engine operation parameter;

detecting engine conditions known to lead to stalling on the basis of the detected operating condition;

recording said engine operation parameter at a moment said engine stall condition is detected as engine stall condition representative data, and accumulating another set of engine stall condition representative data each time the engine stall condition is detected; and comparing detected engine operating conditions with said engine stall condition representative data and performing a prdetermined engine stall-preventive operation, in which the engine output torque is increased relative to the load on the engine, when the detected engine operating condition satisfies a specific relationship with at least one set of said engine stall condition representative data.

5. A method for performing stall preventive control for an internal combustion engine, comprising the steps of:

monitoring an engine operating parameter;

detecting engine operating conditions on the basis of the detected engine operating parameter and determining a pattern of variations in said detected operating conditions over time;

detecting an engine condition known to lead to engine stalling on the basis of detected engine operating conditions by comparing said pattern of variations in said detected operating conditions over time with a known pattern of operating conditions over time which have a high probability of leading to engine stall; and driving an auxiliary drive unit associated with said engine while the engine is running under its own power so as to apply additional torque to the engine when said engine stalling condition is detected.

6. A method for projecting a possible occurrence of engine stall during engine operation, comprising the steps of:

monitoring variations in engine operation parameters;

detecting engine operating conditions on the basis of engine operating parameters;

detecting engine conditions known to lead to engine stalling on the basis of detected engine operating conditions;

recording a pattern of variation of said engine operation parameters each time the engine stalling condition is detected; and comparing the monitored variations of said engine operating parameters with said set engine operation parameter variation patterns to detect engine conditions which may lead to engine stall.

7. A stall preventive control system for an internal combustion engine comprising:

sensor means for monitoring a preselected engine operation parameter and producing a first sensor signal indicative thereof;

means, responsive to said first signal for monitoring variations of said first sensor signal value over a given period of time for establishing an engine driving condition variation pattern and producing a second signal indicative thereof;

means, responsive to said second signal and including means for storing a preset engine operating condition variation pattern over time, which preset pattern is representative of engine operating having a high probability to cause stall, for comparing said variation pattern as indicated by said second signal and said preset pattern for detecting incipient engine stall based on said second signal and producing a third signal when incipient engine stall is detected; and fourth means, associated with said third means and responsive to said third signal, for performing an engine stall preventive operation in which the magnitude of engine output torque relative to the load on the engine is increased.

8. A stall preventive control system for an internal combustion engine comprising:

a first sensor for monitoring a preselected engine operation parameter and producing a first sensor signal indicative thereof;

a second detector for detecting a preselected engine operating condition on the basis of a pattern of variations over time in said first sensor signal and producing a second detector signal indicative thereof;

third means, responsive to said second detector signal, for detecting incipient engine stall based on said second detector signal and producing a third signal when incipient engine stall is detected; and fourth means, associated with said third means and responsive to said third signal, for performing an engine stall preventive operation in which the magnitude of engine output torque relative to the load on the engine is increased, said fourth means comprising a starter motor engageable with the engine and driven by an electrical power source to apply additional torque to the engine in response to said third signal, wherein said starter motor performing said engine stall preventive operation is installed as an auxiliary unit independent of another starter motor used to crank the engine.

9. The engine control system as set forth in claim 8, which further comprises an alternator for generating electric power, said alternator being associated with said fourth means, which in response to said third signal controls the operation mode of said alternator to act as an electric motor driven by a battery power to transmit additional torque to the engine.

10. A stall preventive control system for an internal combustion engine comprising:

a first sensor for monitoring a preselected engine operation parameter and producing a first sensor signal indicative thereof;

a second detector for detecting a preselected engine operating condition of the basis of a pattern of variations over time in said first sensor signal and producing a second detector signal indicative thereof;

third means, responsive to said second detector signal and including means for storing a preset engine operating condition variation pattern over time, which preset pattern is representative of engine operation having a high possibility of resulting in engine stall, for comparing said variation pattern as indicated by said second detector signal and said preset pattern for detecting incipient engine stall based on said second detector signal and producing a third signal when incipient engine stall is detected; and fourth means, associated with said third means and responsive to said third signal, for performing an engine stall preventive operation in which the magnitude of engine output torque relative to the load on the engine is increased.

11. The engine control system as set forth in claim 10, which further comprises a starter motor engageable with the engine, said starter motor being associated with said fourth means to be engaged to the engine and driven by an electrical power source to apply additional torque to the engine in response to said third signal.

12. The engine control system as set forth in claim 10, which further comprises a flywheel engageable with said engine and normally driven by the engine for accumulating engine output in the form of angular momentum, said flywheel supplying additional torque to the engine in response to said third signal.

13. A stall preventive control system for an internal combustion engine comprising:

a first sensor for producing an engine speed indicative first sensor signal indicative of a pattern of engine speed variations over time;

a reference signal generator for producing a second signal representative of an engine speed variation pattern over time which is indicative of a high probability of resulting in engine stalling;

second means for comparing said first sensor signal with said second signal and producing an engine stall indicative signal if said first sensor signal is less than said second signal and remains less than said second sensor signal for a predetermined length of time;

an auxiliary drive unit responsive to said engine stall indicative signal for transmitting torque to the engine while the engine is operating under its own power in order to increase the engine output torque relative to the load on the engine.

14. The engine control system as set forth in claim 13, wherein said auxiliary device is a starter motor which is responsive to said engine stall indicative signal to temporarily apply additional torque to an engine output shaft.

15. The engine control system as set forth in claim 13, wherein said auxiliary device comprises a flywheel driven by engine to accumulate engine power in the form of angular momentum, and responsive to said engine stall indicative signal to return accumulated power to said engine.

16. A stall preventive control system for an internal combustion engine comprising:

a first sensor for producing an engine speed indicative first sensor signal;

a reference signal generator for producing a second signal representative of an engine speed low enough to lead to engine stalling;

second means for comparing said first sensor signal value with said second signal and producing an engine stall indicative signal if said first sensor signal value is less than said second signal value;

an auxiliary drive unit responsive to said engine stall indicative signal for transmitting torque to the engine while the engine is operating under its own power in order to increase the engine output torque relative to the load on the engine, comprising a flywheel driven by the engine to accumulate engine power in the form of angular momentum, and responsive to said engine stall indicative signal to return accumulated power to said engine, wherein said flywheel is connected to an engine output shaft through an electromagnetically operable clutch engaged in response to said engine stall indicative signal.

17. The engine control system as set forth in claim 16, wherein said clutch is engaged when the engine speed is higher than a predetermined speed which is sufficiently high to drive said flywheel without adversely influencing engine performance as well as in response to said engine stall indicative signal.

18. The engine control system as set forth in claim 17, wherein said clutch is engaged to connect said flywheel to said engine output shaft only when engine speed is sufficiently high and the engine is decelerating.

19. A stall preventive control system for an internal combustion engine comprising:

a first sensor for monitoring a preselected engine operation parameter and producing a first sensor signal indicative thereof;

a second detector for detecting a preselected engine operating condition on the basis of variations in said first sensor signal and producing a second detector signal indicative thereof;

third means, responsive to said second detector signal, for detecting incipient engine stall and producing a third signal when incipient engine stall is detected; and fourth means, associated with said third means and responsive to said third signal, for performing an engine stall preventive operation in which the magnitude of engine output torque relative to the load on the engine is increased, wherein said fourth means records said first sensor signal as engine stall condition-indicative data in response to detection of incipient engine stall, compares said engine stall condition-indicative data with said second detector signal and outputs said third signal whenever said second detector signal satisfies a predetermined specific relationship with one of the recorded engine stall condition-indicative data.

20. The engine control system as set forth in claim 19, wherein said engine includes an air induction system including an auxiliary air induction system bypassing a throttle valve, a fuel injection system for injecting fuel into the stream of intake air entering the engine, an ignition system for performing spark ignition in engine cylinders, an exhaust gas recirculation system for recirculating a fraction of the exhaust gas exitting the engine into the intake air stream, and a sixth means controlling the auxiliary air flow rate, the fuel injection amount and timing, the ignition timing and the exhaust gas recirculation rate.

21. The engine control system as set forth in claim 19, which further comprises a fifth detector for detecting the operating state of a vehicle component, affecting engine operation, and said engine stall preventive operation consists of controlling the operating state of said vehicle component.

22. The engine control system as set forth in claim 21, wherein said vehicle component is a transmission gear position.

23. The engine control system as set forth in claim 21, wherein said first sensor monitors engine speed.

24. The engine control system as set forth in claim 21, wherein said first sensor monitors intake air flow rate.

25. The engine control system as set forth in claim 21, wherein said first sensor monitors the pressure of engine lubrication oil.

26. The engine control system as set forth in claim 21, wherein said vehicle component is an air conditioner driven by the engine.

27. The engine control system as set forth in claim 26, wherein said fourth means disables said air conditioner in order to decrease the load on the engine and so increase the relative magnitude of the engine output torque.

28. A stall preventive control system for an internal combustion engine comprising:

a first sensor for monitoring a preselected engine operation parameter and producing a first sensor signal indicative thereof;

a second detector associated with said first sensor for detecting instantaneous engine operating conditions and producing a second detector signal indicative of the engine operating conditions;

a third means, for recording said first sensor signal value as engine stall condition-indicative data in response to the second detector signal indicative of engine conditions known to lead to stalling;

fourth means, responsive to said second detector signal, for deriving engine operating condition data and comparing the derived engine operating condition data with said engine stall condition-indicative data to output a third signal indicative of engine conditions known to lead to stalling with a high probability when said engine operating condition satisfies a predetermined relationship with said engine stall condition-indicative data; and fifth means, associated with an accessory device of an engine, for operating said accessory device in response to said third signal so as to increase the magnitude of the engine output torque relative to the load on the engine.

29. The engine control system as set forth in claim 28, wherein said accessory device comprises an alternator for generating electric power and operative as an electrically driven motor, and said fifth means responds to said third signal by operating said alternator as an electrically driven motor to apply torque to the engine to increase the total engine output torque.

30. The engine control system as set forth in claim 29, wherein said first sensor monitors engine speed and produces an engine speed-indicative first sensor signal, said third means produces a reference signal indicative of an engine speed low enough to lead to stalling, and said fourth means compares said engine speed-indicative first sensor signal value with said reference signal value and produces said third signal if said first sensor signal value is less than said reference value.

31. The engine control system as set forth in claim 28, which further comprises a sixth detector for detecting the operating state of said accessory device, the operation of which influences engine operation, and said fourth means selects which of a plurality said engine stall condition-indicative data is to be compared with said engine operating condition data depending upon the operating state of said accessory device.

32. The engine control system as set forth in claim 31, wherein said accessory device is an air conditioner including a compressor driven by the engine.

33. The engine control system as set forth in claim 32, wherein said fifth means temporarily disables said air conditioner in response to said third signal.

34. The engine control system as set forth in claim 28, wherein said accessory device is a starter motor, and said fifth means is responsive to said third signal to temporarily operate said starter motor to transmit additional torque from said starter motor to an engine output shaft.

35. The engine control system as set forth in claim 34, wherein said starter motor is independent of another starter motor used for engine cranking.

36. The engine control system as set forth in claim 35, wherein said first sensor monitors engine speed and produces an engine speed-indicative first sensor signal, said third means produces a reference signal indicative of an engine speed low enough to lead to stalling, and said fourth means compares said engine speed-indicative first sensor signal value with said reference signal value and produces said third signal if said first sensor signal value is less than said reference value.

37. The engine control system as set forth in claim 28, wherein said accessory device comprises a flywheel driven by the engine to accumulate engine power in the form of angular momentum, and said fifth means is responsive to said third signal to operate said flywheel to return accumulated power to said engine.

38. The engine control system as set forth in claim 37, wherein said flywheel is connected to an engine output shaft through an electromagnetically operable clutch, and said fifth means controls the engagement and disengagement of said clutch.

39. The engine control system as set forth in claim 38, wherein said clutch is engaged when the engine speed is higher than a predetermined speed which is sufficiently high to drive said flywheel without adversely influencing engine performance, and said fifth means engages said clutch in response to said third signal.

40. The engine control system as set forth in claim 39, wherein said clutch is engaged to connect said flywheel to said engine output shaft only when engine speed is sufficiently high and the engine is decelerating.

41. The engine control system as set forth in claim 40, wherein said first sensor monitors engine speed and produces an engine speed-indicative first sensor signal, said third means produces a reference signal indicative of an engine speed low enough to lead to stalling, and said fourth means compares said engine speed-indicative first sensor signal value with said reference signal value and produces said third signal if said first sensor signal value is less than said reference value.

42. The engine control system as set forth in claim 28, wherein each of engine stall condition-indicative data consists of a plurality of first sensor signal values sampled at regular intervals for a predetermined period of time after each second detector signal.

43. The engine control system as set forth in claim 42, wherein said fourth means derives said engine operating condition data in the same manner as said engine stall condition-indicative data, and said fourth means calculates the integral of the absolute difference between corresponding values of said engine stall-indicative data and said engine operating condition data and produces said third signal when said integral value is smaller than a given value.

44. The engine control system as set forth in claim 43, wherein said first sensor monitors engine revolution speed.

45. The engine control system as set forth in claim 44, wherein said third means includes a memory storing variation patterns of engine speed leading to engine stalling as said engine stall condition-indicative data.

46. The engine control system as set forth in claim 45, wherein said fourth means compares said engine operating condition data with each variation pattern of said engine stall condition-indicative data and produces said third signal if the integral of the absolute difference between corresponding values of said engine operating condition data and any of said engine stall condition-indicative data variation patterns is equal to or smaller than said given value.

47. The engine control system as set forth in claim 46, wherein said accessory device comprises an automotive air conditioner including a compressor driven by the engine, and said fifth means temporarily disables said air conditioner in response to said third signal.

48. The engine control system as set forth in claim 46, wherein said accessory device comprises an alternator for recharging a vehicle battery, and said fifth means reduces the load on said alternator in response to said third signal.

* * * * *